US011850527B2

(12) United States Patent
Ben Lulu

(10) Patent No.: US 11,850,527 B2
(45) **Date of Patent: *Dec. 26, 2023**

(54) SYSTEMS, DEVICES AND METHODS FOR NETWORK MANAGEMENT OF REMOTE MODIFICATION OF CARDS

(71) Applicant: DBEST Limited Liability Company, Kyiv (UA)

(72) Inventor: Dekel Ben Lulu, Kiev (UA)

(73) Assignee: DBEST Limited Liability Company, Kyiv (UA)

( * ) Notice: Subject to any disclaimer, the term of this patent is extended or adjusted under 35 U.S.C. 154(b) by 0 days.

This patent is subject to a terminal disclaimer.

(21) Appl. No.: 17/245,184

(22) Filed: Apr. 30, 2021

(65) Prior Publication Data

US 2021/0252378 A1 Aug. 19, 2021

Related U.S. Application Data

(63) Continuation-in-part of application No. 17/082,066, filed on Oct. 28, 2020.

(60) Provisional application No. 62/928,626, filed on Oct. 31, 2019.

(51) Int. Cl.

| | |
|---|---|
| ***A63F 3/06*** | (2006.01) |
| ***G07F 17/32*** | (2006.01) |
| ***A63F 3/08*** | (2006.01) |

(52) U.S. Cl.

CPC ..... *A63F 3/0645* (2013.01); *A63F 3/064* (2013.01); *A63F 3/0605* (2013.01); *A63F 3/081* (2013.01); *G07F 17/329* (2013.01); *A63F 2003/088* (2013.01)

(58) Field of Classification Search

CPC ..... A63F 3/0645; A63F 3/0605; A63F 3/064; A63F 3/081; A63F 2003/088; G07F 17/329

See application file for complete search history.

(56) References Cited

U.S. PATENT DOCUMENTS

| | | | | |
|---|---|---|---|---|
| 6,065,181 | A * | 5/2000 | Cleveland | A47L 5/26 15/93.1 |
| 9,044,787 | B1 * | 6/2015 | Stewart | B08B 1/002 |
| 2007/0037499 | A1 * | 2/2007 | Burbridge | B24B 19/223 451/359 |
| 2020/0070563 | A1 * | 3/2020 | Martineck, Sr. | G07F 17/329 |
| 2020/0226866 | A1 | 7/2020 | Heuman | |

FOREIGN PATENT DOCUMENTS

| | | | |
|---|---|---|---|
| DE | 2601838 | A1 | 7/1977 |
| EP | 0414454 | A2 | 2/1991 |
| JP | 2000334920 | A | 12/2000 |
| KR | 102142246 | B1 | 8/2020 |

* cited by examiner

*Primary Examiner* — Werner G Garner

(74) *Attorney, Agent, or Firm* — The Roy Gross Law Firm, LLC; Roy Gross

(57) ABSTRACT

The disclosure relates to devices, systems, methods and computer readable media for providing network management of remote card handling, and physical manipulation. More particularly, the disclosure is directed to networked devices, systems, methods and computer program methods for remotely, physically modifying a card while leaving a physical record of the modified card for inspection and validation and delivering the manipulation results to a user, and/or other third parties, for example, scratch lottery cards and ballot cards.

24 Claims, 12 Drawing Sheets

SYSTEMS, DEVICES AND METHODS FOR NETWORK MANAGEMENT OF REMOTE MODIFICATION OF CARDS

COPYRIGHT NOTICE

A portion of the disclosure hereinbelow contains material that is card to copyright protection. The copyright owner has no objection to the reproduction by anyone of the patent document or the patent disclosure as it appears in the Patent and Trademark Office patent files or records, but otherwise reserves all copyright rights whatsoever.

COMPUTER PROGRAM LISTING APPENDIX

Applicant incorporates by reference the Computer Program Listing Appendix entitled "09332-P0001B-Appendix.txt" into this application. This filed was created Jul. 25, 2023 and is 97 KB.

BACKGROUND

The disclosure is directed to devices, systems, methods and computer readable media for providing network management of remote cards' handling, and physical manipulation. More particularly, the disclosure is directed to networked devices, systems, methods and computer program for physically modifying cards such as, for example, scratch lottery cards and ballot cards.

Current interest in lottery games have resulted in a wide range of publicly promoted games conducted throughout the world. These games take several forms including the well-known scratch card games in which winning numbers are determined by scratching off a covering layer on cards to disclose the winning numbers.

In addition, on-line drawings and participation has increased the popularity of the whole lottery system to the point where, in certain circumstances it is possible to buy a lottery subscription with either random number selected each time, or the same number played at each drawings. Furthermore, regulations are highly variable concerning when and how scratch cards can be validated as winning.

Similarly, election law and security is continuously requiring the combination of electronic voting for fast results, combined with the creation of paper-trail to provide traceability and preventing of fraud The following disclosure intends to address these requirements.

SUMMARY

Disclosed, in various embodiments, are devices, systems, methods and computer readable media for remotely, physically modifying and creating physical changes of paper (and other materials') cards, while maintaining a unique record of the physical card. More specifically, provided herein are computerized methods of remotely scratching a lottery card, or alternatively, physically marking the card to elect a representative, while registering the result and maintaining a physical record of the scratched or marked card at the location where it is affected, all in a networked system.

In an embodiment provided herein is a. networked device for physically modifying a plurality paper cards, comprising: a physical manipulation module (PMM); an unmodified card holder; an unmodified card conveyor a modified card holder; a modified card conveyor; an imaging module; optionally a cleaning module; and a central processing module (CPM) in communication with the PMM, the unmodified card holder, the unmodified card conveyor, potentially the cleaning module, the modified card holder the modified card conveyor, and the imaging module, the CPM further comprising: a transceiver in communication with a communication network; and at least one processor in communication with a non-volatile storage device having thereon a processor-readable medium with a set of executable instructions configured, when executed, to cause the at least one processor to: receive a request for modifying at least one unmodified card; using the unmodified card conveyor, convey the unmodified card from the unmodified card holder to the PMM; physically manipulate the card; analyze the modified used card; transmit the analysis; and convey the used card to the used cards holder.

In another embodiment, provided herein is a networked computerized card-modifying system, comprising: a plurality of computerized card modifying terminals, each terminal comprising: a physical manipulation module (PMM); an unmodified card holder; an unmodified card conveyor; a used/modified card holder; a used/modified card conveyor; an imaging module; optionally a cleaning module; and a central processing module (CPM) in communication with the PMM, the unmodified card holder, the unmodified card conveyor, potentially the cleaning module, the modified card holder the modified card conveyor, and the imaging module, the CPM further comprising: a transceiver in communication with a communication network; and at least one processor in communication with a non-volatile storage device having thereon a processor-readable medium with a set of executable instructions configured, when executed, to cause the at least one processor to: receive a request for modifying at least one unmodified card; using the unmodified card conveyor, convey the unmodified card from the unmodified card holder to the PMM; physically manipulate the card; analyze the modified used card; transmit the analysis; and convey the used card to the used cards holder a client terminal comprising: a display; a communication interface, adapted for two-way communication with the communication network; a user interface, adapted to provide the user input; and a processor, in communication with the display, the communication interface, and the user interface, the processor being in communication with a non-volatile storage device having thereon a processor-readable medium with an application program interface configured, when executed, to cause the processor to: receive input from the user configured to select a card to be remotely physically modified; transmit the selected card to a backend management server; receive an analysis of the physical manipulation of the selected card; and render the analysis results on the display; the unmodified card issuing entity; and a backend management server comprising: a management communication interface, adapted for two-way communication with the communication network; a first non-volatile storage device; and a backend processing module (BPM) in communication with each card modifying terminal, the client terminal, and the unmodified card-issuing entity, the BPM further comprising at least one backend processor in communication with a non-volatile storage device having thereon a processor-readable medium with a set of executable instructions configured, when executed, to cause the at least one processor to: receive the unmodified card selection from the user terminal; locate a predetermined card modifying terminal; transmit the selection to the predetermined card modifying terminal; receive the analysis transmittal from the predetermined card modifying terminal; and based on the analysis, inform the card issuing entity.

In yet another embodiment, provided herein is a method of remotely physically scratching a scratch-lottery card (SLC) by a user, implementable in a computerized networked system comprising: a plurality of computerized SLC modifying terminals, each terminal comprising: a physical manipulation module (PMM); an unmodified SLC holder; an unmodified SLC conveyor; a used SLC holder; a used SLC conveyor; an imaging module; a cleaning module; and a central processing module (CPM) in communication with the PMM, the unmodified SLC holder, the unmodified SLC conveyor, potentially the cleaning module, the used SLC holder the used SLC conveyor, and the imaging module, the CPM further comprising: a transceiver in communication with a communication network; and at least one processor in communication with a non-volatile storage device having thereon a processor-readable medium with a set of executable instructions configured, when executed, to cause the at least one processor to: receive a request for remotely scratching at least one unmodified SLC; using the unmodified SLC conveyor, convey the unmodified SLC from the unmodified SLC holder to the PMM; scratching the SLC; analyze the scratched SLC; transmit the analysis; and provide the analysis to the user a client terminal comprising: a display; a communication interface, adapted for two-way communication with the communication network; a user interface, adapted to provide the user's input; and a processor, in communication with the display, the communication interface, and the user interface, the processor being in communication with a non-volatile storage device having thereon a processor-readable medium with an application program interface (API) configured, when executed, to cause the processor to: receive input from the user configured to select the SLC to be remotely scratched; transmit the selected SLC to a backend management server; receive an analysis of the selected, remotely scratched SLC; and render the analysis results on the display; the unmodified SLC issuing entity; and a backend management server comprising: a management communication interface, adapted for two-way communication with the communication network; a first non-volatile storage device; and a backend processing module (BPM) in communication with each SLC modifying terminal, the client terminal, and the unmodified SLC-issuing entity, the BPM further comprising at least one backend processor in communication with a second non-volatile storage device having thereon a processor-readable medium with a set of executable instructions configured, when executed, to cause the at least one processor to: receive the unmodified SLC selection from the user terminal; locate a predetermined SLC modifying terminal; transmit the selection to the predetermined SLC modifying terminal; receive the analysis transmittal from the predetermined SLC modifying terminal; and based on the analysis, optionally inform the SLC issuing entity, the method comprising: selecting at least one SLC by the user; transmitting a request to the backend management server by the user terminal to scratch the selected SLC; the backend management server, allocating a predetermined SLC modifying terminal; transmitting the request to the predetermined SLC modifying terminal; and remotely scratching the SLC by the predetermined SLC modifying terminal.

These and other features of the devices, systems, methods and computer readable media for affecting remote modification and manipulation of cards while maintaining the modified or modified card record, will become apparent from the following detailed description when read in conjunction with the figures and examples, which are exemplary, not limiting.

BRIEF DESCRIPTION OF THE FIGURES

For a better understanding of the devices, systems, methods and computer readable media for remotely, physically modifying a card while leaving the modified card intact in storage for further review and validation, reference is made to the accompanying examples and figures, in which.

DETAILED DESCRIPTION

Figure 1:
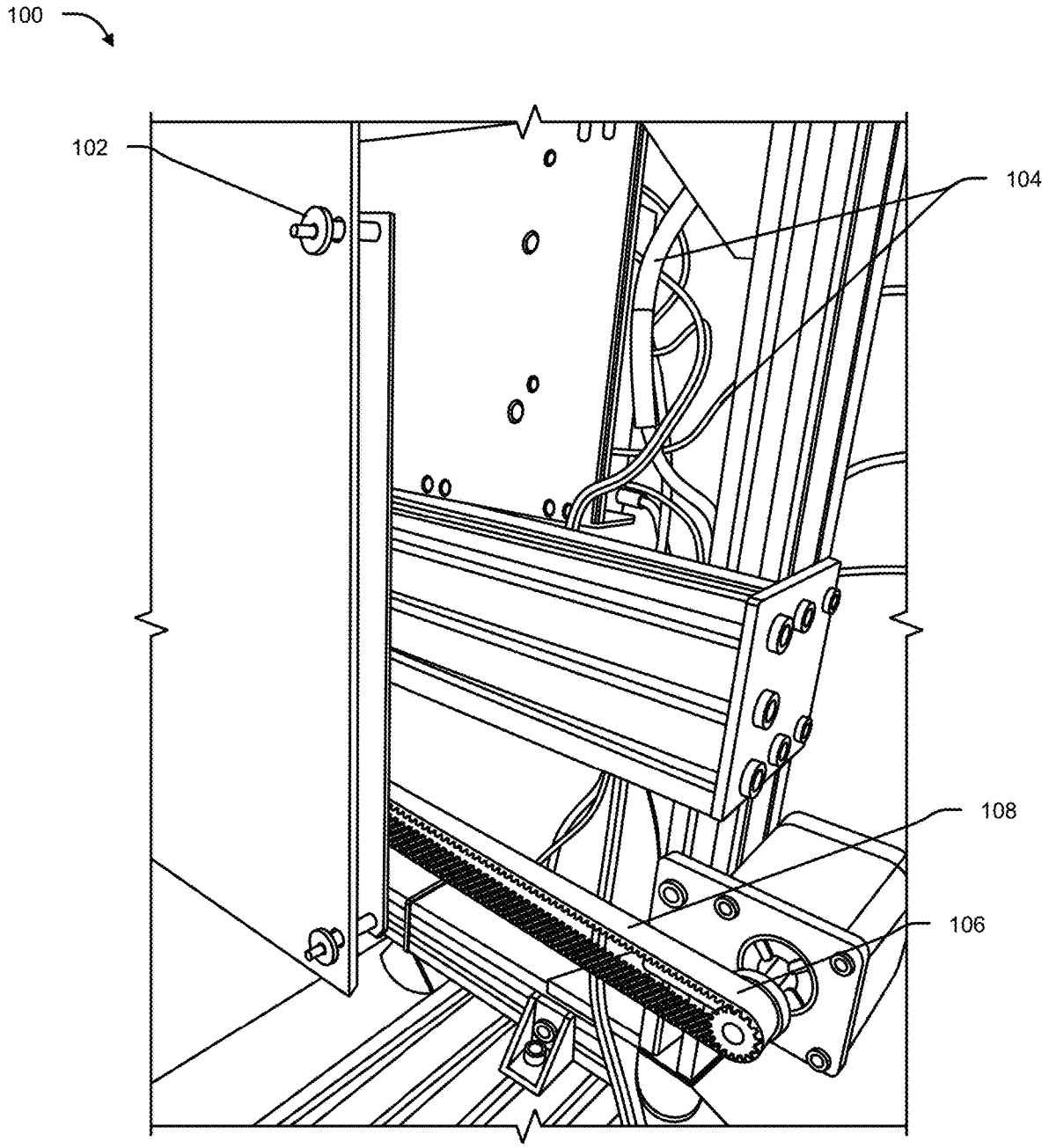
FIG. 1, shows an embodiment of the motion-adaptive platform to affect the physical modification of the card of the computerized networked remote manipulation device.

Provided herein are embodiments of devices, systems, methods and computer readable media for remotely, physically modifying a card while leaving the modified card intact in a secured storage for further review, inspection and validation. More particularly, provided herein are embodiments of methods of remotely, physically modifying a card while leaving a record of the modified card for inspection and validation and delivering the manipulation results to a user, and/or other third parties.

Therefore, provided herein is a networked device for physically modifying a plurality paper (or other materials) cards (in other words, a slab or film having defined borders), comprising: a physical manipulation module (PMM) (see e.g., FIG. 3); an unmodified card holder (see e.g., FIG. 2); an unmodified card conveyor 254 (see e.g., FIG. 2B) a modified card holder 256; a modified card conveyor 254; an imaging module (see e.g., 406 FIG. 4B); optionally a cleaning module; and a central processing module (CPM) (see e.g., 600 FIGS. 5, 6) in communication with the PMM, the unmodified card holder 256, the unmodified card conveyor 254, potentially the cleaning module, the modified card holder 256 the modified card conveyor 254, and the imaging module 406, the CPM further comprising: a transceiver 506 (see e.g., FIG. 5) in communication with a communication network; and at least one processor in communication with a non-volatile and non-transient storage device having thereon a processor-readable medium with a set of executable instructions configured, when executed, to cause the at least one processor to: receive a request for modifying at least one unmodified card; using the unmodified card conveyor, convey the unmodified card from the unmodified card holder to the PMM; physically manipulate the card; analyze the modified used card; transmit the analysis; and convey the used card to the used cards holder.

The device is a computerized networked device forming a node for a networked computerized card-modifying system, comprising: a plurality of computerized card modifying terminals, each terminal comprising: a physical manipulation module (PMM); an unmodified card holder; an unmodified card conveyor; a modified card holder; a modified card conveyor; an imaging module; optionally a cleaning module; and a central processing module (CPM) in communication with the PMM, the unmodified card holder, the unmodified card conveyor, potentially the cleaning module, the modified card holder the modified card conveyor, and the imaging module, the CPM further comprising: a transceiver in communication with a communication network; and at least one processor in communication with a non-volatile storage device having thereon a processor-readable medium with a set of executable instructions configured, when executed, to cause the at least one processor to: receive a request for modifying at least one unmodified card; using the unmodified card conveyor, convey the unmodified card from the unmodified card holder to the PMM; physically manipulate the card; analyze the modified used card; transmit the analysis; and convey the used card to the used cards holder a client terminal comprising: a display; a communication interface, adapted for two-way communication with the communication network; a user interface, adapted to provide the user input; and a processor, in communication with the display, the communication interface, and the user interface, the processor being in communication with a non-volatile storage device having thereon a processor-readable medium with an application program interface configured, when executed, to cause the processor to: receive input from the user configured to select a card to be remotely physically modified; transmit the selected card to a backend management server; receive an analysis of the physical manipulation of the selected card; and render the analysis results on the display; the unmodified card issuing entity; and a backend management server comprising: a management communication interface, adapted for two-way communication with the communication network; a first non-volatile storage device; and a backend processing module (BPM) in communication with each card modifying terminal, the client terminal, and the unmodified card-issuing entity, the BPM further comprising at least one backend processor in communication with a non-volatile storage device having thereon a processor-readable medium with a set of executable instructions configured, when executed, to cause the at least one processor to: receive the unmodified/unused card selection from the user terminal; locate a predetermined card modifying terminal; transmit the selection to the predetermined card modifying terminal; receive the analysis transmittal from the predetermined card modifying terminal; and based on the analysis, inform the card issuing entity.

The term "system" shall also be taken to include any collection of systems or sub-systems that individually or jointly execute a set, or multiple sets, of instructions to perform one or more functions. Also, the term "system" refers to a logical assembly arrangement of multiple devices, and is not restricted to an arrangement wherein all of the component devices are in the same housing.

In the context of the disclosure, the term "modified" and/or "physically modified" refers to (and derivatives thereof) of a card refers to any re-shaping, perforating, removal of a portion of the card, erasing ink therefrom, adding marking thereto, forming indentations therein, and the like, whether accomplished with springs, friction, dampeners elements, pins, printing, hole punchers, or other structures, devices, means or methods. As such, modifying such card may be accomplished by frictional effects, spring mechanisms, dampener mechanisms, servo motors, pneumatic actuators, other devices (and their equivalents) described herein, and any combination of these. Further, the term "card" in the context of the disclosure refer to any flat slab or film sized, configured and adapted to deliver a commercial, public, or commercial message, such as, for example, a lottery scratch card, ticket, photograph, compact disc, bank note, check, greeting card, gift card, election ballot and the like. Additionally, the term "card" should be understood to include any suitable materials, including stiff and flexible materials whether fabricated from paper, cardboard, plastics material, metal or otherwise. In an embodiment, the unused/unmodified card is at least one of: a lottery scratch card (LSC), and an election ballot card (EBC).

Following the modification of the card using the systems, devices, method and computer programs described herein, there may be the need to further treat the cards, for example by cleaning the face of the card from any remnants of the modification. These can be, for example, any ink or card portion removed by punching, erasing, cutting and the like of the card. Accordingly and in another embodiment, the set of executable instructions are further configured, when executed, to cause the at least one processor in the card modifying terminals to: prior to analyzing the modified used card, using the used cards conveyor, conveying the used card to the cleaning module; and cleaning the modified used card. In the context of the disclosure, unmodified/unused card refers to the card before any modification, while used card refer to the card after the remote physical modification.

FIG. 1 illustrates an exemplary computerized networked remote manipulation device 100 (also interchangeably referred to as "networked device" hereinafter) in accordance with an exemplary implementation. In an exemplary implementation, the proposed networked device 100 can be configured to, based on instructions received from a remote computing device, physically modify one or more physical cards (such as lottery scratch cards (LSC) or election ballot cards (EBC)) that are received by said device 100, and particularly perform modification of the received physical card(s) based on instructions received from the remote computing device. It would be appreciated that at the time when a physical card (also simply referred to as card or card(s) hereinafter) is first received by the proposed networked device 100, said card would be referred to as an "unmodified card", and upon receipt of the instructions from the remote computing device, when the proposed device 100 modifies the unmodified card, it would be referred to as a "modified card".

Figure 6:
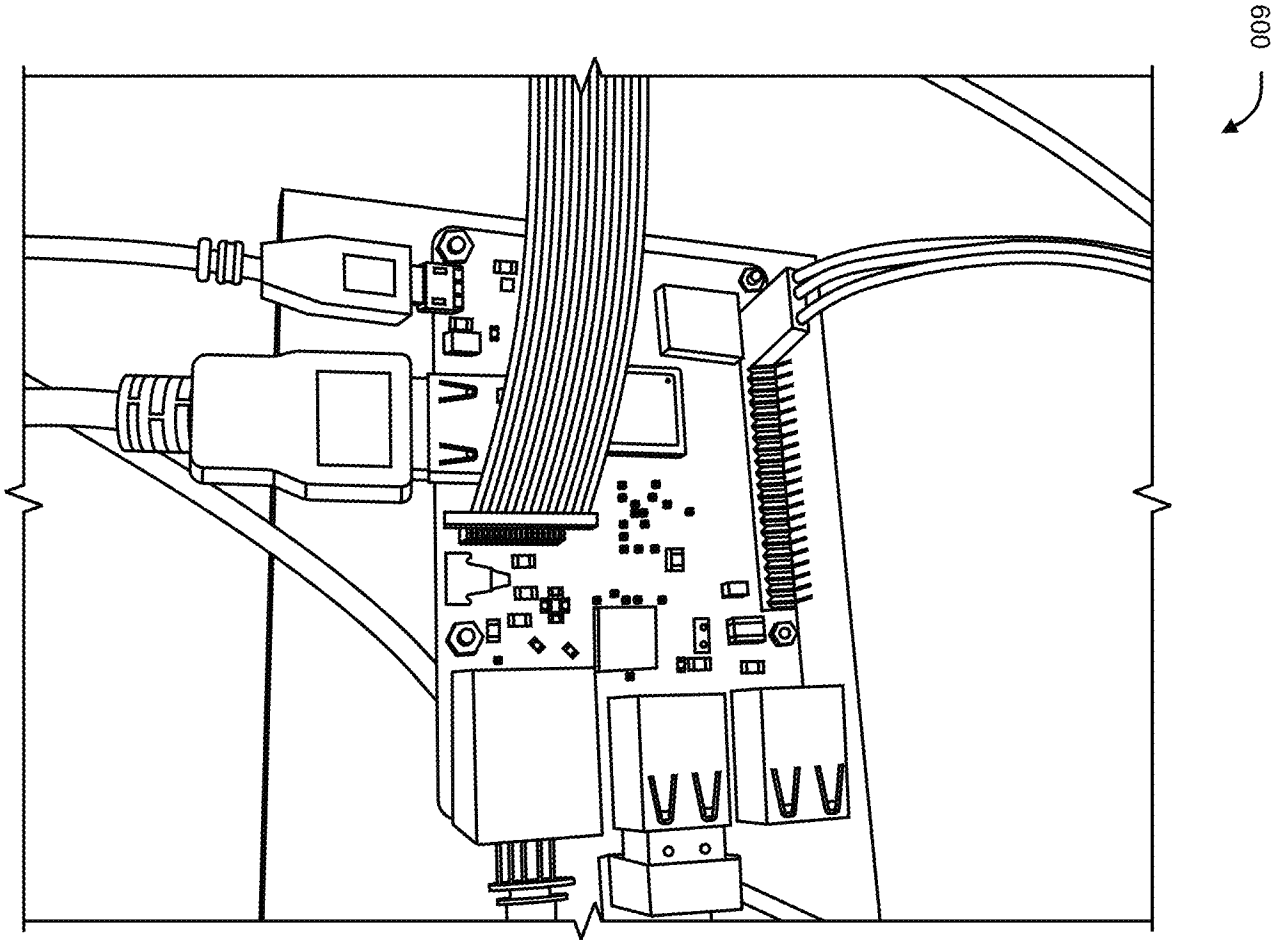
FIG. 6, shows an embodiment of the CPM of the computerized networked remote manipulation device.

In an aspect, the proposed networked device 100 can include one or more components (not shown in FIG. 1) selected from any or a combination of a physical modification module (PMM) (300 of FIG. 3), an unmodified card holder (200 of FIG. 2A), an unmodified card conveyor 108, a modified card holder 256 (see e.g., FIG. 2B), a modified card conveyor 254 (interchangeable with rotatable transfer drum), an imaging module (406 of FIG. 4), optionally a cleaning module (Not Shown), and a central processing module (CPM) (600 of FIG. 6). The proposed networked device 100 can be constructed using materials such as steel, aluminum, and the like or a combination thereof. Components of the proposed networked device 100 can be fixed/coupled with each other using screws and/or bolts 102. In an aspect, the proposed networked device 100 can include one or more cables 104 that can be incorporated within the device 100 so as to enable communication between various components. In an aspect, the proposed networked device 100 can further include a belt shaft 106 that can aid in movement of the unmodified cards 248*i* such that upon processing of said unmodified cards 248*i* by the proposed device 100, the modified cards 248'*i* can be conveyed on a modified card conveyor 108 to a cleaning module (Not Shown) prior to the modified card being analyzed.

In an aspect, networked device 100 can be configured to, based on instructions received from a remote computing device, physically modify one or more cards, wherein the device 100 can include a central processing module (CPM) (600 of FIG. 6) that can assist and facilitate communication with the PMM (300 of FIG. 3), the unmodified card holder (200 of FIG. 2A), the unmodified card conveyor 108, the cleaning module, the modified card holder, the modified card conveyor, and the imaging module (400 of FIG. 4). The CPM (600) can further include a transceiver 506 (see e.g., FIG. 5), in communication with/through a network, and can further include at least one processor that is in communication with a non-volatile storage device. The storage device can further include a processor-readable medium with a set of executable instructions so as to enable the processor to receive a request (for instance, from the remote computing device (not shown)) for modifying at least one unmodified physical card. Based on such a received request, the unmodified card can be conveyed from the unmodified card holder (200 of FIG. 2A) using the unmodified card conveyor ( . . . ) to the PMM (300 of FIG. 3). The PMM (300 of FIG. 3) can then, in turn, physically modify the unmodified card based on the instructions received from the CPM (600), and analyze the modified card. Such analysis can include, but not limited to, detection of the presence of physical manipulation of/on the selected card, analysis of the modified used card, and examination of the scratched lottery card. In an exemplary aspect, PMM (300 of FIG. 3) can be configured to transmit the analysis to the CPM (600), along with delivering the modified card to the modified card holder 256 using the modified card conveyor (see e.g., 254 FIG. 2A (interchangeable with).

In an aspect, before undertaking the modification process, PMM (300 of FIG. 3) can be configured to remove a portion present in/on the unmodified card ( . . . ) in X-Y direction. In another aspect, PMM (300 of FIG. 3) of the proposed networked device 100 can be configured to modify the physical card by removing ink that may be present on at least one predetermined location of the physical card.

In an aspect, the proposed network device 100 can include an imaging module (406 of FIG. 4B) along with a camera lens (406 of FIG. 4B) so as to capture and process images of the physical card. In an embodiment, the proposed imaging module (400 of FIG. 4) can include one or more charge coupled devices (CCDs), a complimentary metal-oxide semiconductor (CMOS), and/or a combination comprising one or more of the foregoing. In aspect, the proposed networked device 100 can relate to a motion-adaptive platform that can enable modification of the physical card through automated image quality analysis of the captured image(s).

Figure 2A:
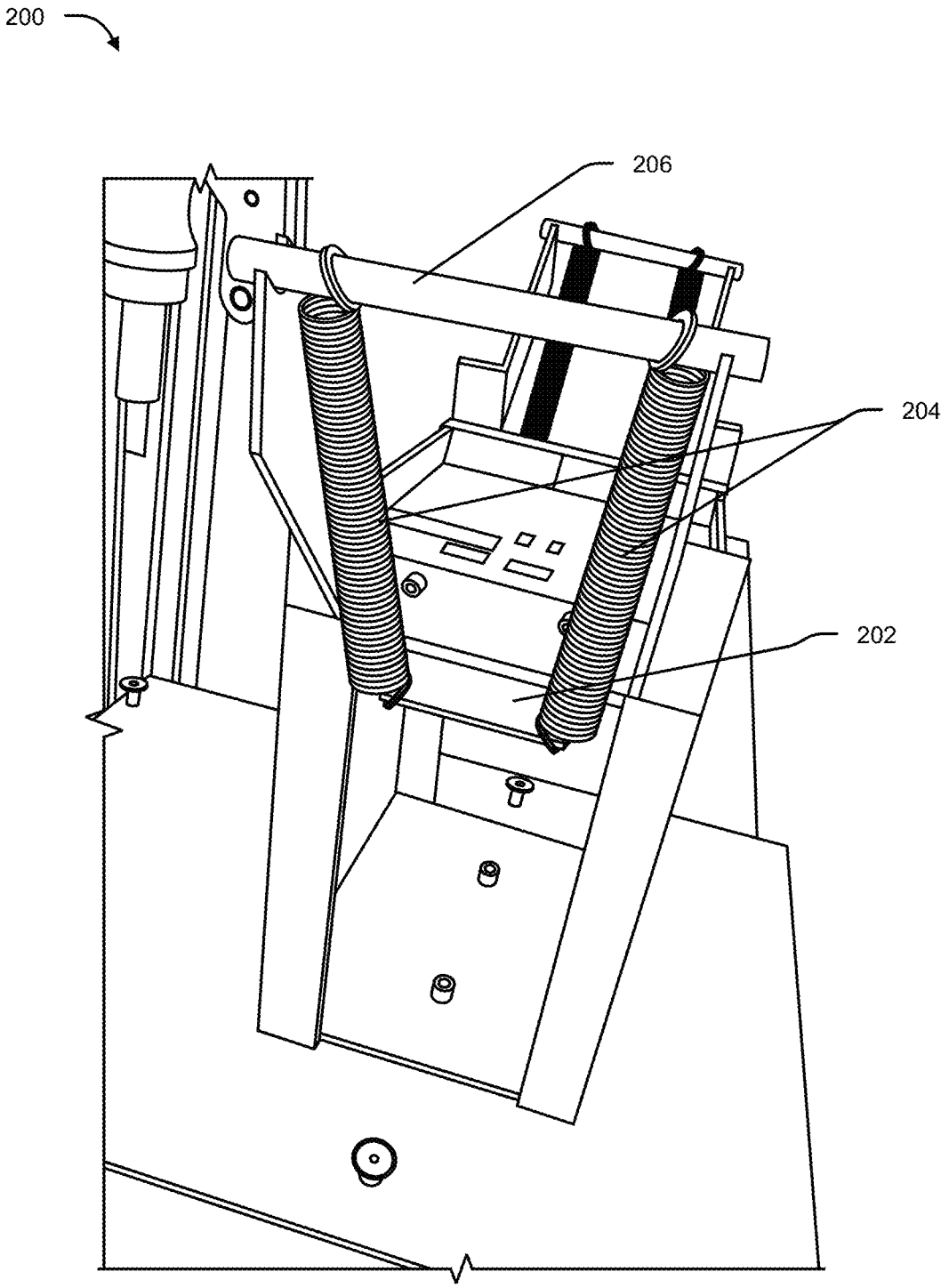
FIG. 2A, shows an embodiment of the unmodified card holder of the computerized networked remote manipulation device.

FIG. 2A illustrates an exemplary unmodified card holder 200 of the proposed networked device 100 in accordance with an exemplary implementation. In an exemplary implementation, unmodified card holder 200 (also interchangeably referred to as unused cards holder) can include a slot 202 to receive one or more physical cards, a pair of springs 204, and a rod 206 passing through a portion of said pair of springs. In an exemplary aspect therefore, one end of each of the springs 204 can be coupled to the slot 202, while the other end is coupled to the rod 206. In an exemplary implementation, the unmodified card holder 200 can be configured to receive a request for modifying at least one unmodified card using the unmodified card conveyor, based on which the said request can be transmitted from the unmodified card holder 200 to the PMM 300.

Figure 2B:
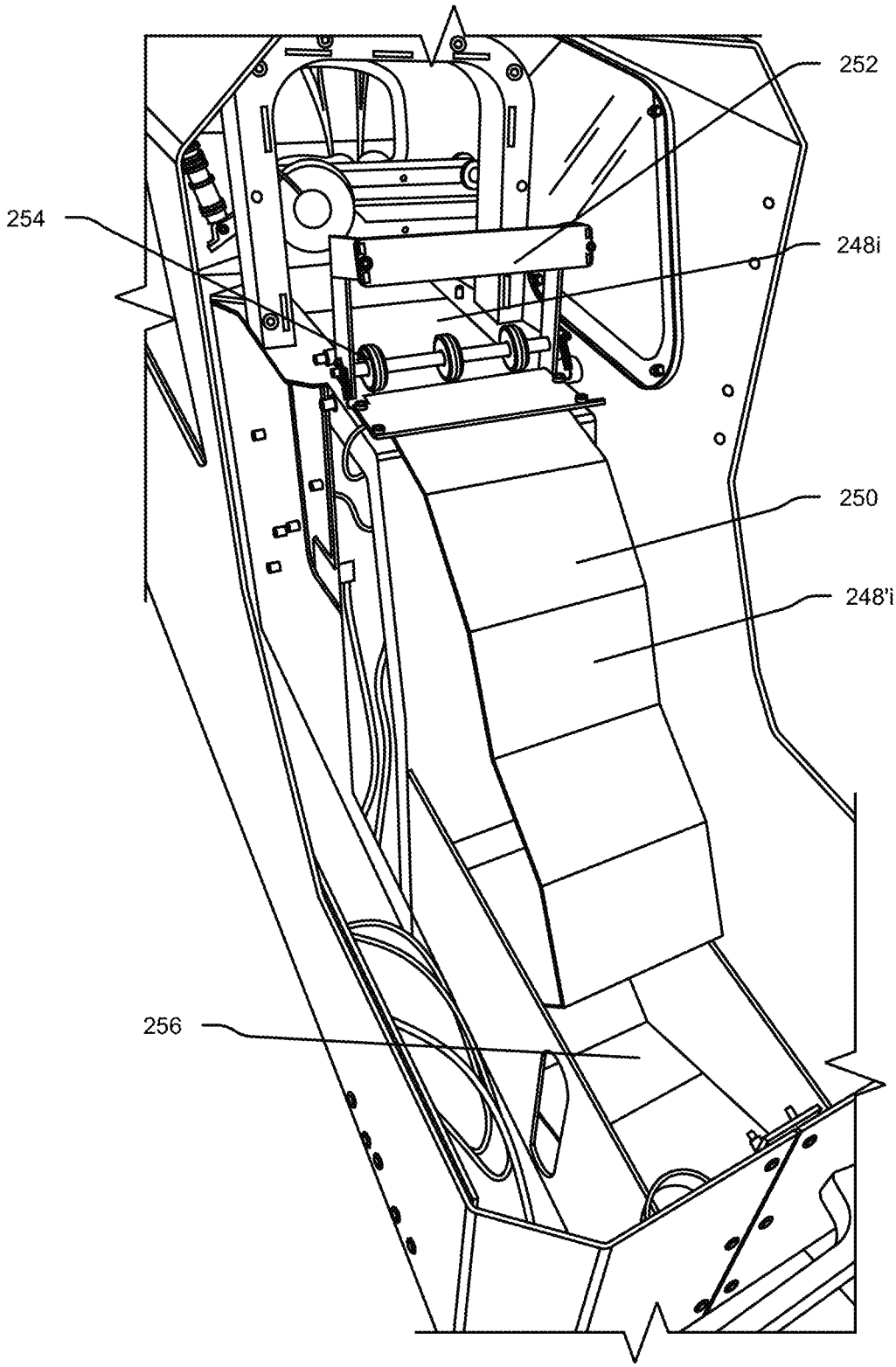
FIG. 2B, shows an embodiment of the card roll.

In another exemplary implementation, and as illustrated schematically in FIG. 2B, the unmodified cards 248*i* can be provided on a roll of cards, and unmodified card holder 200 can be operable to draw the scored (perforated) roll (or otherwise indexed through rotatable transfer drum 256 indexing using, for example, an encoder, or marked with machine-readable marking etc.) in an indexed manner to present the indexed section of the roll to PMM 300 for further processing. Accordingly and in another exemplary implementation, provided herein is a transversely scored roll of cards (unmodified to start and modified in the end) adapted to be fed to PMM 300 for the purpose of transferring cards to be manipulated (lottery, election ballots) thereto from an unmodified card roll without concern that such transfer will be imperfect, or will leave voids adjacent the score lines as the card roll moves through the networked device 100. In other words, the individual cards, or a plurality of cards, can be Z-folded at a certain stage in the transfer between the unmodified and modified cards holder(s). In the context of the disclosure, the term Z-fold, as well as the card configuration within the roll, means any configuration in which the region of connection between successive cards alternates between two different regions removed from each other such that the first region serves as the trailing portion of a first card and a leading portion of a second card and the second region serves as the trailing portion of the second card and the leading portion of the third card and so on.

As illustrated, the pre-scored (or otherwise separated or indexed), card roll (250 of FIG. 2B) is shown being fed from the roll (252 of FIG. 2B) through device 100 which includes, rotatably mounted transfer drum 254. Card roll (250) can be located in the unmodified card holder 200 that comprises unmodified cards 248*i* that are transferred from the roll 250 to the PMM 300 of device 100 for the purpose of permitting the physical manipulation (the physical scratch-off) and then under the imaging/scanning module to capture an image of the manipulated card. As the pre-scored/indexed/marked/gapped roll is then discharged from the imaging/scanning module, it can be rolled up at that time to form the Z-folding as shown. The number of cards in a Z-fold can be controlled by the length of the modified cards holder 256 length.

Figure 3:
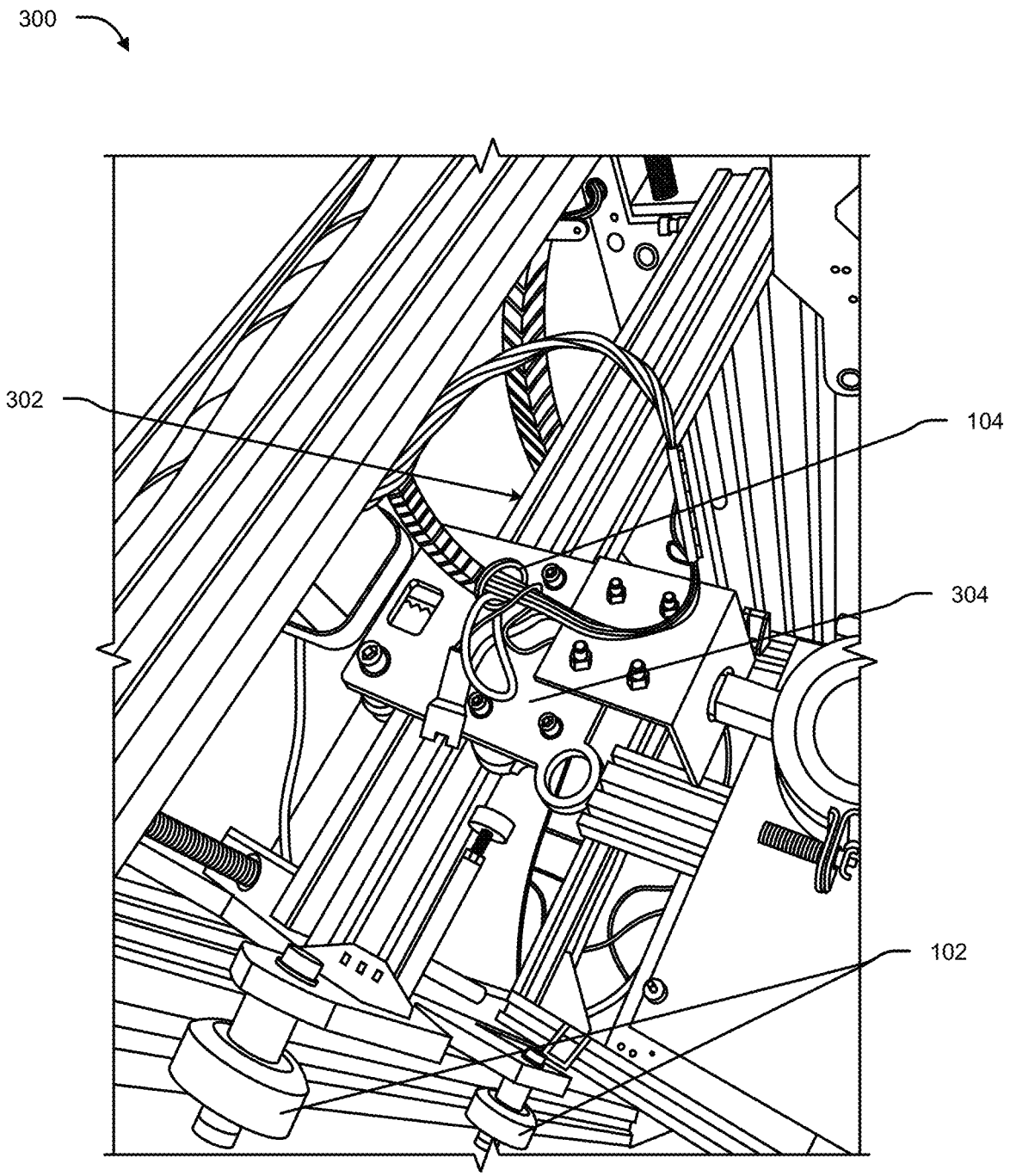
FIG. 3, shows an embodiment of the physical manipulation module (PMM) of the computerized networked remote manipulation device.

FIG. 3 illustrates an exemplary physical modification module (PMM) 300 of the proposed networked device 100 in accordance with an exemplary implementation. In an exemplary implementation, the PMM 300 can be operatively coupled with a conveying platform 302 and a modifying member 304, said modifying member 304 being configured to receive, over the conveying platform 302 (which, in an exemplary implementation, can be the unmodified card conveyor), an unmodified card, and physically process/modify said card to convert the same into a modified card.

In an exemplary aspect, modifying member 304 of the PMM 300 can be configured to, at its distal end, remove a portion of the unmodified/unused card that is received over the conveying platform 302. The conveying platform 302 can be configured to move at least one of the modifying member 304, distal end of the modifying member 304, and/or the unmodified card in X-Y direction. As illustrated in FIG. 3, PMM 300 can enable/control movement of the modifying member 304 (e.g., distal end of an arm of the member 304 or an elongated member of the member 304 that is adapted and configured to re-shape, perforate, or remove the desired portion of the unmodified card by, for instance, forming/creating opening(s), hole(s), indentation(s), embossed mark(s), etc, in/on the unmodified card at predetermined location(s)), erase ink therefrom (in other words, remove ink at predetermined location(s) on the card(s) face(s)), add marking(s) thereto, form indentation(s) therein, and the like) by change in X-Y orientation of the member 304 with respect to the card through short or long steps. Such steps can be controlled by the main processor (see e.g., FIG. 6) and optimized to produce maximum efficiency in modifying (e.g., scratching) the card in the shortest time.

Figure 4A:
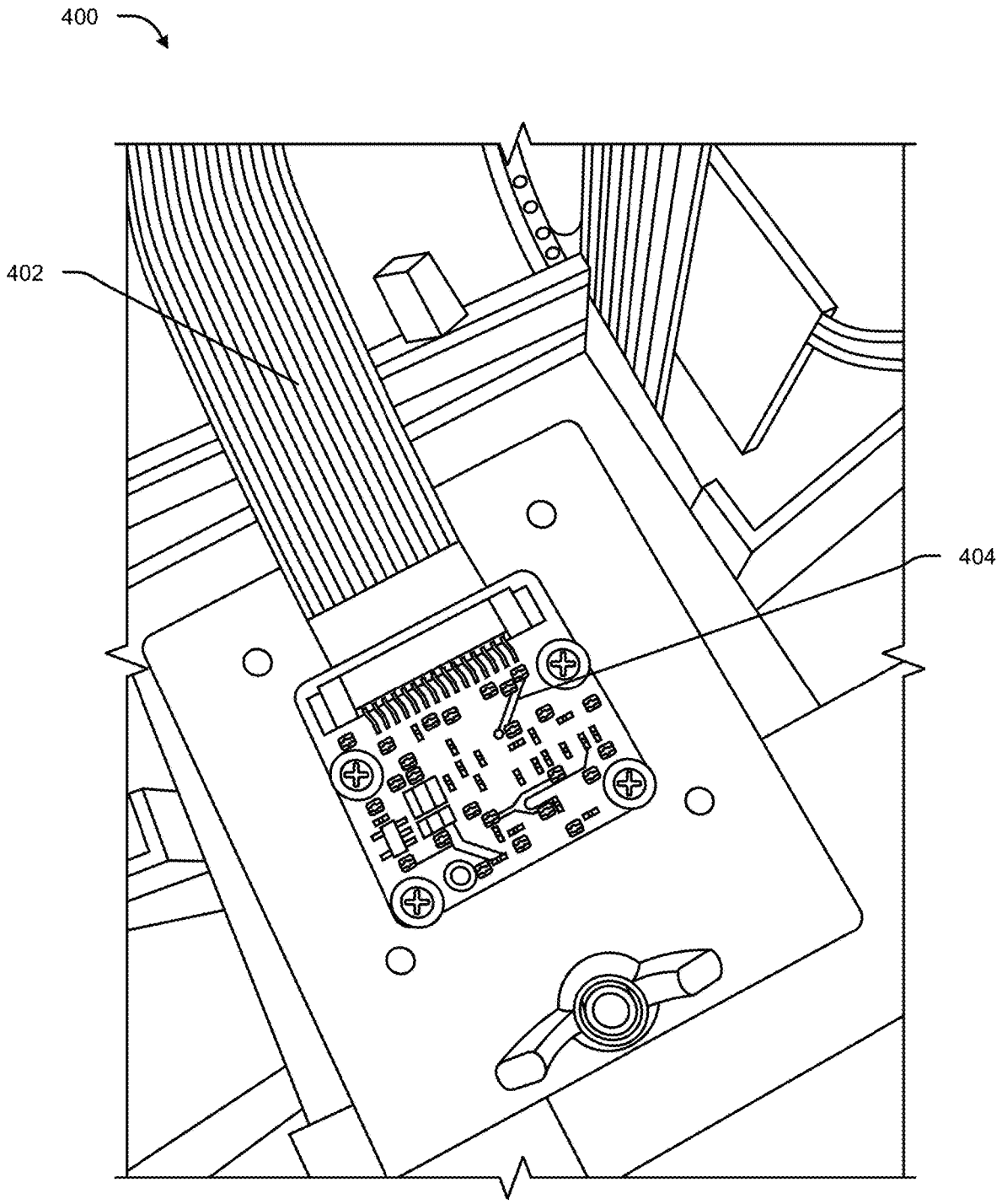
FIG. 4A, shows an embodiment of the imaging module PCB controller, with FIG. 4B shows an embodiment of the camera lens of the computerized networked remote manipulation device.
Figure 4B:
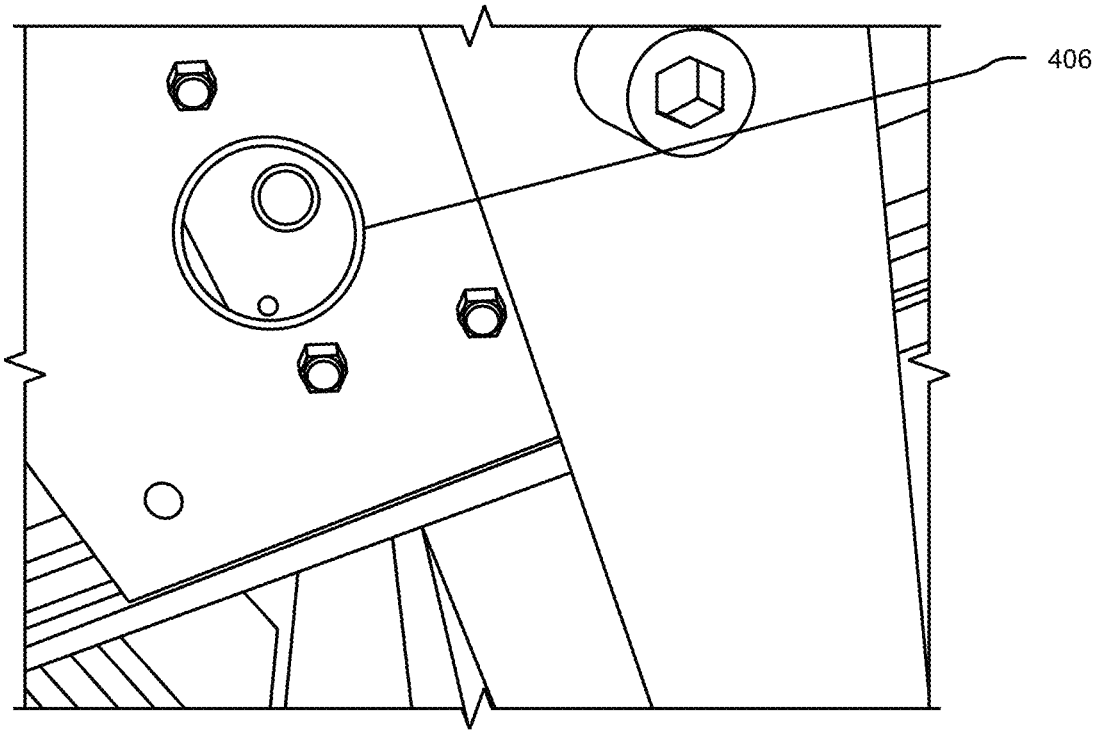

FIGS. 4A and 4B illustrate exemplary representations of the imaging module 400 of present invention that forms part of the proposed networked device 100. In an exemplary aspect, the imaging module 400 can include a PCB controller and a camera lens 406. In an exemplary implementation, the controller can include one or more charge coupled devices (CCDs), a complimentary metal-oxide semiconductor (CMOS) (404) that can be connected to the components of the proposed networked device 100 via a cable assembly 402. In another exemplary embodiment, camera lens 406 of the proposed networked device 100 can be configured to capture one or more images of the physical card, and transmit said images to any or a combination of the remote computing device or the central processing module (CPM).

With respect to FIGS. 4A and 4B, card modifying terminals (see e.g., $\mathbf{802}_i$, FIG. 8) can further include an imaging module sized, adapted, and configured to capture images of the used (modified) card. The imaging module can include one or more charge coupled devices (CCDs), a complimentary metal-oxide semiconductor (CMOS) or a combination comprising one or more of the foregoing. If static images are required, the imaging module can comprise a digital frame camera, where the field of view (FOV) can be predetermined by, for example, the camera size and the distance from the card's face. The cameras used in the imaging modules of the systems, devices, method and computer programs described herein, can be a digital camera. The term "digital camera" refers in an embodiment to a digital still camera, a digital video recorder that can capture a still image of an object and the like. The digital camera can comprise an image capturing unit or module, a capture controlling module, a processing unit (which can be the same or separate from the CPM). The imaging module (see e.g., FIG. 4A, 4B), can also be configured to transmit video feed to either the client terminal display (see e.g., $\mathbf{851}_j$, FIG. 8), or CPM (see e.g., FIG. 6). The video/stills can be transmitted using radio frequency, Bluetooth, ZigBee, or cellular networks. In an embodiment, the video encoding can have a format of H.264, H.265, MPEG, and the like.

Figure 5:
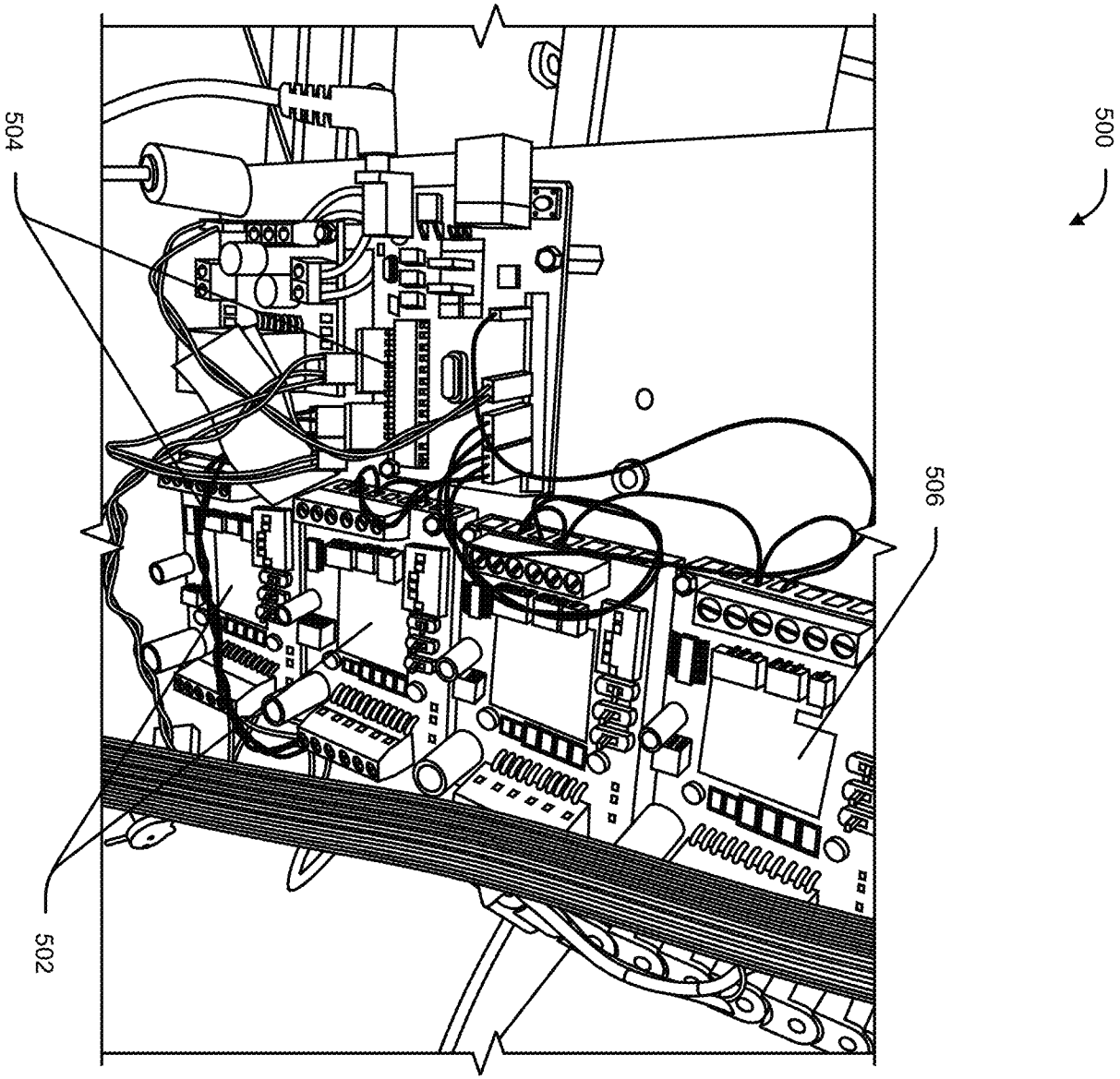
FIG. 5, shows an embodiment of the drivers and controllers forming a portion of the central processing module (CPM) of the computerized networked remote manipulation device.

FIG. 5 illustrates an exemplary backend portion of central processing module (CPM) 600 of the proposed networked device 100 in accordance with an exemplary implementation. In an exemplary implementation, backend portion of the central processing module (CPM) 600 can include one or more driver(s) 504 and/or controller(s) 502. The proposed networked device 100 can include one or more hardware components, each of which can be operated through its respective driver 504 that can be provided by vendor of the associated hardware device and loaded as part of the operating system. Driver 504 can allow operating system and applications running on the proposed networked device 100 to communicate with the proposed networked device 100 and control its operations. The controller 502 can handle incoming and outgoing signals of the central processing module (CPM) 500. Additionally, controller(s) 502 can be responsible for transferring data between the proposed networked device 100 and the remote computing device.

In an exemplary implementation, driver(s) 504 can be configured to communicate with one or more components of the proposed networked device 100 such as PMM (300 of FIG. 3), unmodified card holder (200 of FIG. 2A), unmodified card conveyor, optionally the cleaning module, physically modified card holder, modified card conveyor, and imaging module (400 of FIG. 4). Further, controller 502 can be configured to receive data from a remote computing device, and store it temporarily in the proposed networked device 100*m* before communicating the same to the driver 504.

FIG. 6 illustrates an exemplary central processing module (CPM) 600 of the proposed networked device 100 in accordance with an exemplary implementation. In an exemplary implementation, central processing module (CPM) 600 can include a transreceiver, and at least one processor. The central processing module (CPM) 600 can be configured to communicate with various components of the proposed networked device 100 such as the PMM (300 of FIG. 3), the unmodified card holder (200 of FIG. 2A), the unmodified card conveyor, potentially the cleaning module, the physically modified card holder, the modified card conveyor, and the imaging module (400 of FIG. 4). Transceiver 506 (see e.g., FIG. 5) of the central processing module (CPM) 600 can be configured to communicate with a communication network, and at least one processor of the central processing module (CPM) 600 can be configured to communicate with a non-volatile storage device.

In an aspect, processor of the central processing module (CPM) 600 can be configured to receive a request for modifying at least one unmodified card using the unmodified card conveyor. Further, the unmodified card can be conveyed from the unmodified card holder to the PMM which can modify the physical card and analyze the modified card. Further, the analysis is transmitted and the modified card is delivered to the modified cards 248'*i* holder 256.

In an aspect, imaging module (400 of FIGS. 4A and 4B) can be configured to transmit video feed to the CPM 600. The camera lens 406 of the proposed networked device 100 captures an image of the analyzed modified lottery card transmits to the CPM 600. Processor of the CPM 600 can be configured to determine if the modified lottery card is a winning lottery card. In case the modified lottery card is the winning lottery card, the card can be provided for manual monitoring; otherwise the captured image can be transmitted to originating user access terminal.

Figure 7A:
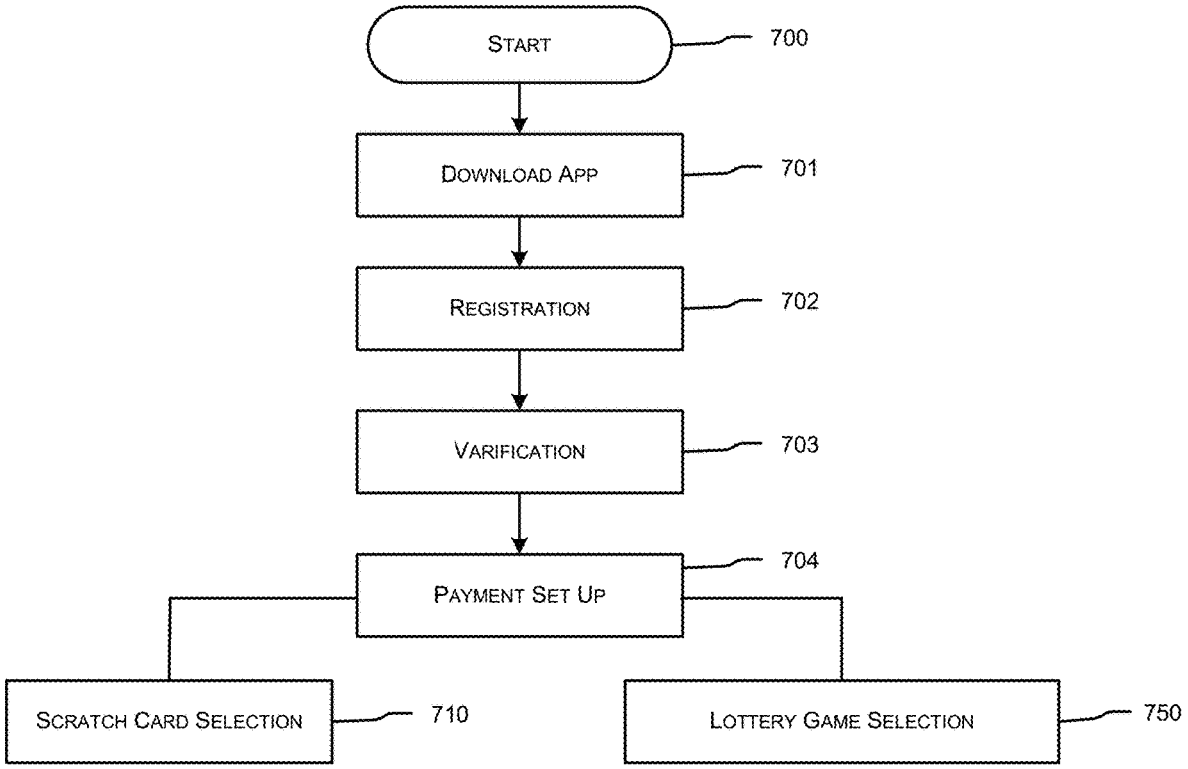
FIGS. 7A-7C, are an embodiment of a flow chart illustrating the method for remotely, physically modifying a card while leaving a record of the modified card for inspection and validation.
Figure 7B:
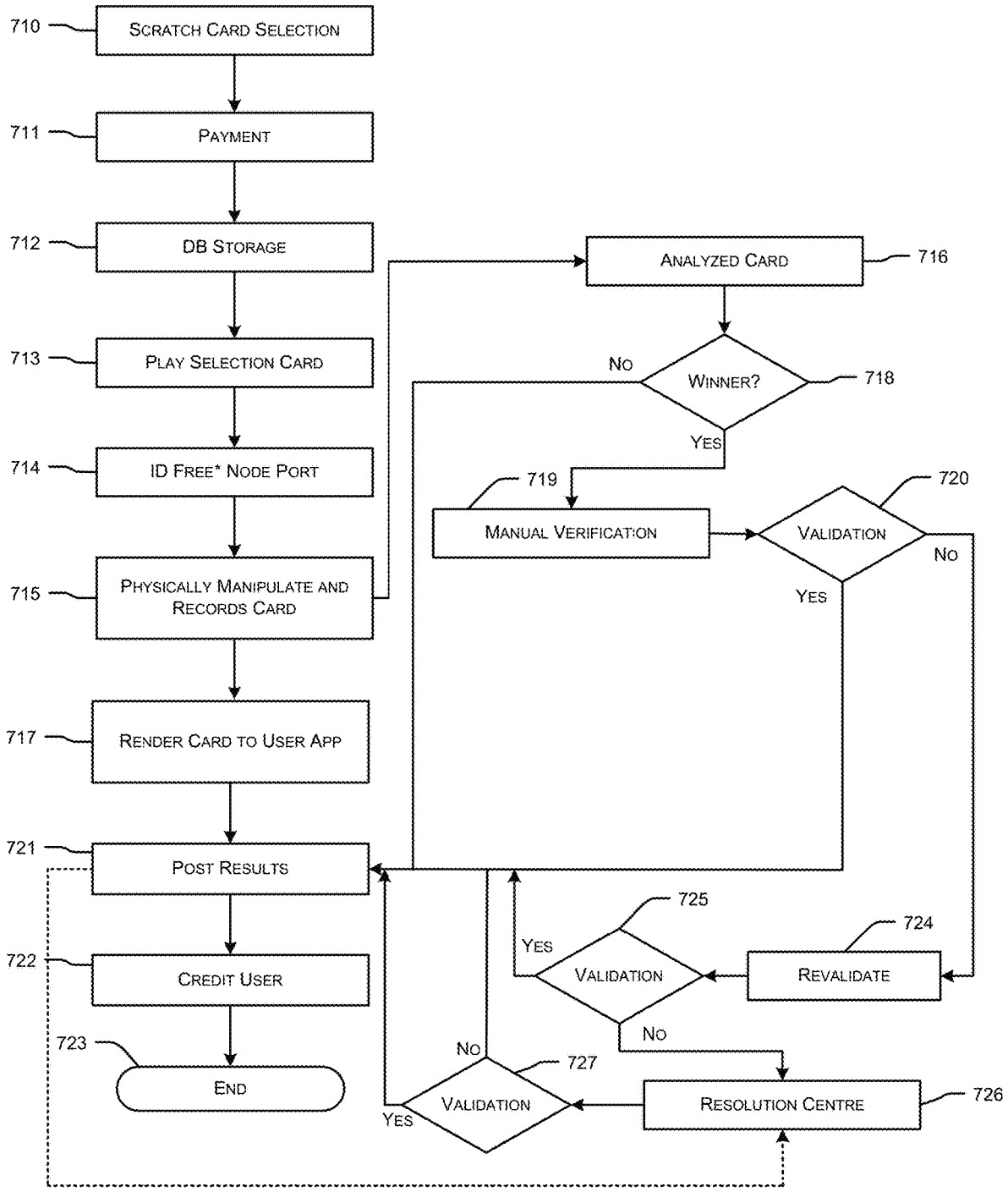
Figure 7C:
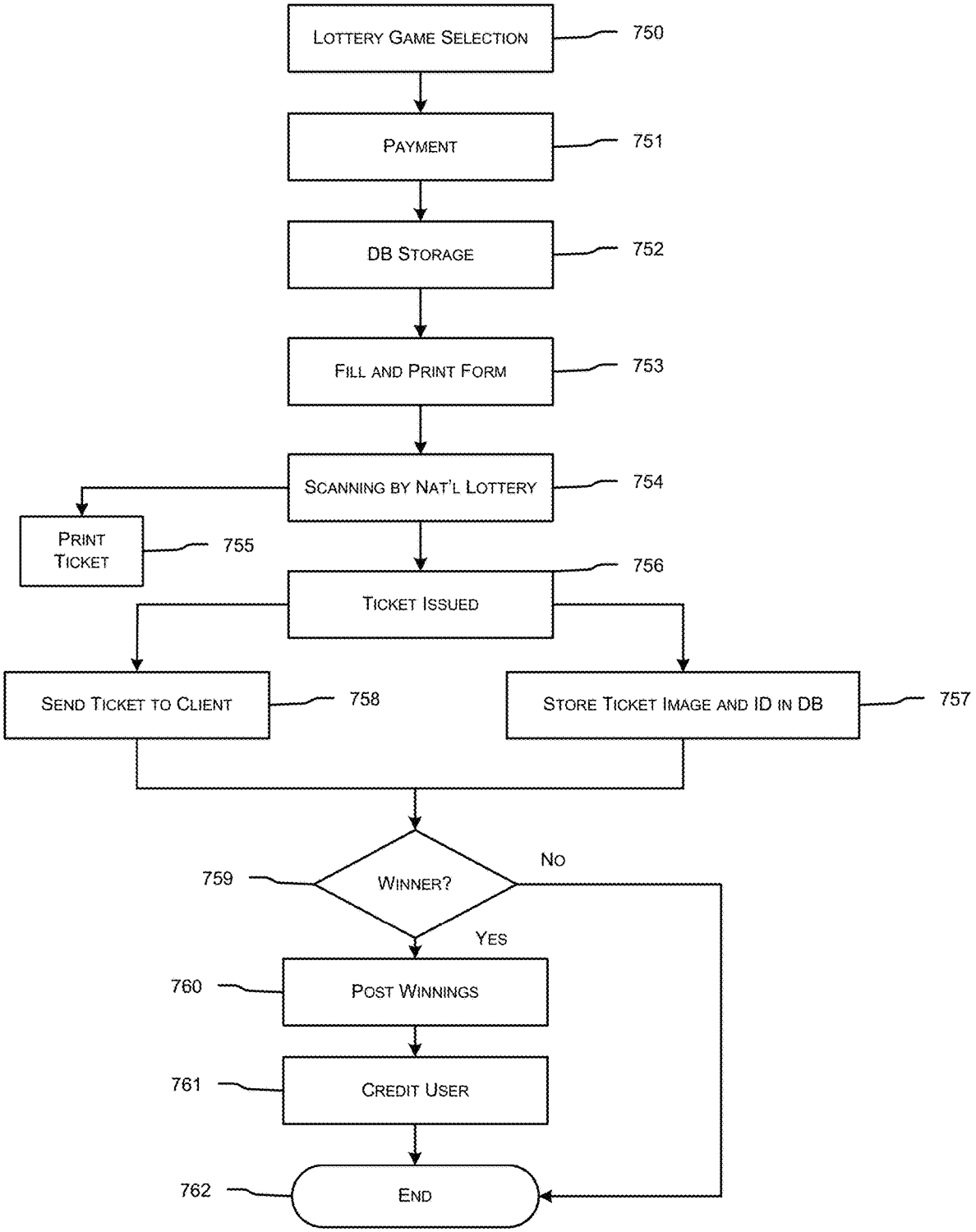

FIGS. 7A-7C illustrate exemplary flow diagrams of the proposed networked device 100 in accordance with an exemplary implementation. In an exemplary implementation, FIG. 7A illustrates an exemplary flow diagram 700 that describes detailed steps for setting up an application in the proposed networked device 100. At step 701, a user (850 of FIG. 8) can download an application on the proposed networked device 100. The application can be configured to perform specific service by including Application Program Interface (API). At step 702, the user (850 of FIG. 8) can be directed to perform registration by including basic details such as name, DOB, age, region and the like. At step 703, the user (850 of FIG. 8) receives a verification link where the identify of the user (850 of FIG. 8) is verified by using various means such as OTP or fingerprint authentication and the like. At step 704, the user (850 of FIG. 8) sets up the payment method for engaging the service on the network. All above steps 700-704 forms a part of the user's authentication and authorization by the network.

In an aspect, once the user (850 of FIG. 8) is authenticated and registered, the user profile can be stored in the database on the backend management server. Now, the user (850 of FIG. 8) can choose to play the lottery by using a scratch lottery card (SLC) 710 or by entering a lottery drawing by purchasing a lottery ticket 750.

Figure 8:
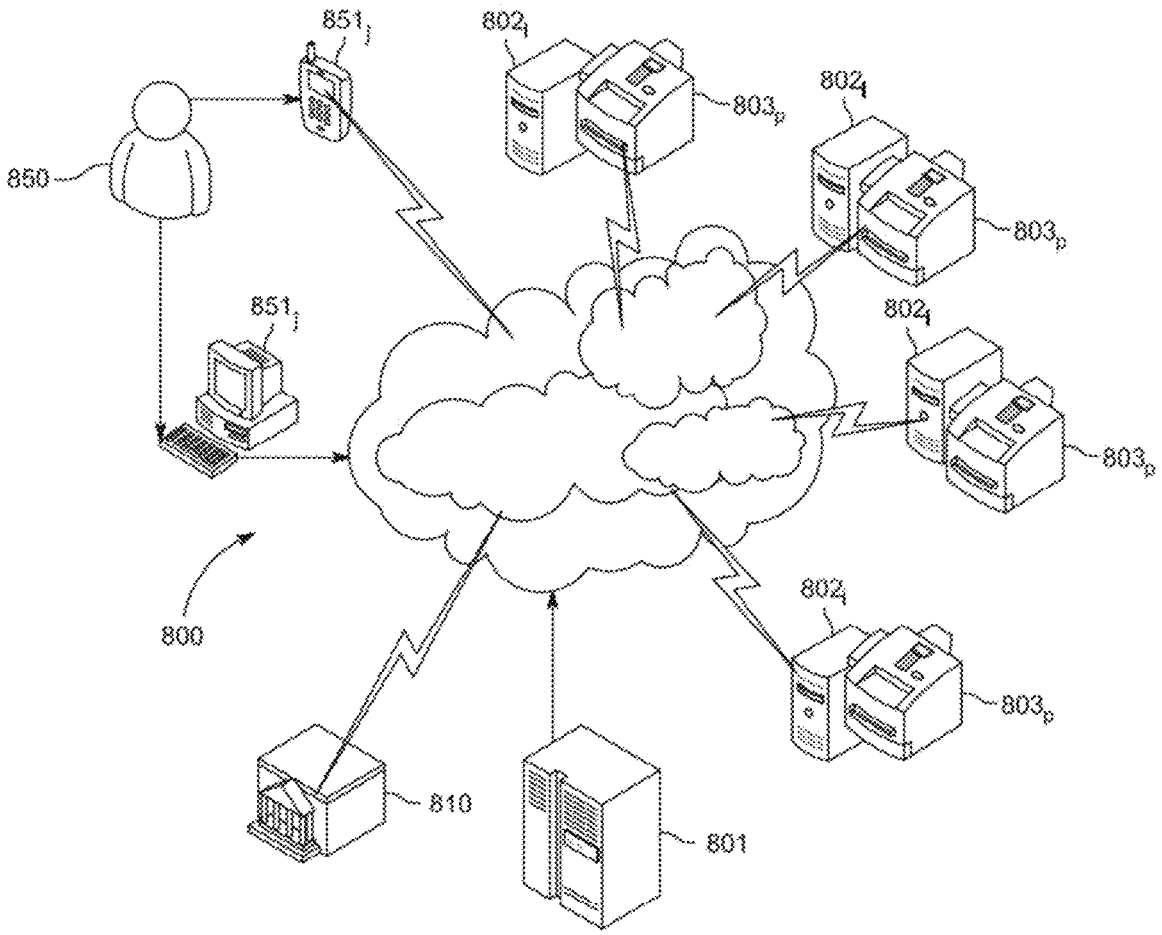
FIG. 8, is a schematic illustrating the networked system for remotely, physically modifying a card while leaving a record of the modified card for inspection and validation.

FIG. 8 illustrates an exemplary schematic diagram for illustrating the networked system for modifying the physical cards remotely while leaving a record of the modified card for inspection and validation in accordance with an exemplary implementation. The card modifying terminals $\mathbf{802}_i$ further comprise image printing modules, configured when prompted, to print lottery tickets (see flow e.g., FIG. 7C). In the context of the subject disclosure, the term "printing module" refers to an image forming device(s) that uses a combination of various types of image forming systems, for example, an image forming apparatus that uses a combination of an electrophotographic system and an inkjet system. Also included, are multi-function peripherals (MFP) $\mathbf{803}_p$ (see e.g., FIG. 8) in which various functions such as the copy function, printer function, facsimile function, scanner function and image data saving function are integrated in one device. The system is configured to implement the functions as needed using remote commands from the BMS.

The MFP in each card modifying terminal further comprises a character and image recognition functionality (OCR/OIR). In the context of the disclosure, term "optical character recognition" encompasses both optical and digital character recognition, and that use of the term "optical character recognition" or "OCR" encompasses any mechanism for translating images of text, pictures, graphics, etc. into machine-editable text and/or a standard encoding scheme. In other words, OCR refers to computer-based translation of an image of typewritten text into machine-editable text or a picture of characters into a standard encoding scheme. For example, the OCR engine used in the card modifying terminal(s) is operably coupled to a flatbed scanner which scans text (e.g., of the printed lottery ticket) or a picture (of the scratch-off card modified thus). The system can be further configured to place the card/ticket flush against the scanning face of the scanner, an image generated by the scanner typically exhibits even contrast and illumination, reduced skew and distortion, and high resolution. Accordingly, the OCR engine, forming a portion of the MFP module, easily translates the text/picture in the card and/or ticket into machine-editable text or standard encoding scheme.

Furthermore, using the encoding scheme, the system can be further configured to compare the obtained image to images stored digitally in a database to make sure there are no fraud attempt in trying to cash a winning ticket twice. In one example, the database storing the digital representations of the winning tickets and/or scratch cards (obtained from the MFP module in card modifying terminal(s) $\mathbf{802}_i$) is in communication with the BMS.

Likewise, both display module and the processor of the client access terminal may further comprise a user interface module, whereby, "user interface module" broadly refers to any visual, graphical, tactile, audible, sensory, or other means of providing information to and/or receiving information from the user or other entity. For example, a set of instructions which enable presenting a graphical user interface (GUI) on display module of client access terminal $\mathbf{851}_j$ to user 850 (see e.g., FIG. 8) for displaying and changing and or inputting data associated with a request in data fields. In an embodiment, the user interface module is capable of displaying any data that it reads from imaging module (see e.g., FIG. 4A, 4B), or display module of client access terminal $\mathbf{851}_j$. Accordingly and in an embodiment, client access terminal 851*j* comprises a display; a communication interface, adapted for two-way communication with the communication network; a user interface, adapted to provide the user input; and a processor, in communication with the display, the communication interface, and the user interface, the processor being in communication with a non-volatile storage device having thereon a processor-readable medium with an application program interface (API) configured, when executed, to cause the processor to: receive input from the user configured to select a card to be remotely physically manipulated; transmit the selected card to a backend management server; receive an analysis of the physical manipulation of the selected card; and render the analysis results on the display.

In an embodiment, the computerized, networked card modification devices are used as card modifying terminal(s) in the systems, method and computer programs described herein. It is noted, that the system provided herein contemplates the presence of a plurality of card-modifying terminals and client access terminals, all accessing and being accessed simultaneously through the network. The term "network terminal" in the context of the card-modifying terminal(s) and client access terminal(s), refer to any device (for example, client access terminal(s) 8511, and card modifying terminal(s) $\mathbf{802}_i$) that is accessible via an internet protocol (IP) network, such as for example, at least one of: a server, a personal computer, and laptop or notebook, linked to the IP network via a fixed or wireless link or a PDA or a smart phone linked to the IP network via a wireless link, and the term "Network Access Terminal" refers to any device, such as for example a mobile phone, able to be connected to a Mobile Communication Network. The term (terminal), may further include some or all the functionality of, a user equipment (UE), a wireless or wired communication device, a network device, a personal communication device, mobile device, and/or a mobile station. In an embodiment, the network access terminal can be a hotspot, referring to a public access venue, location and/or geographical area in which a wireless access point (WAP) provides wireless network services (e.g. 802.11a/b/g/n based or supported services, WiMax based or supported services, cellular network based or supported services such as via CDMA, HSDPA, GPRS, etc., and other such services) to mobile users through a wireless local area network (WLAN), metropolitan area network (MAN), wide area network (WAN), or the like, using, for example but not limited to, Wi-Fi technology or the like.

As indicated, the systems disclosed further comprise, a network node, a card issuing entity (see e.g., 810 FIG. 8). The card-issuing entity can be, for example, a lottery administrating agency, an election administering agency, their combination and the like. The card-issuing entity can be any third party that issues a card or, for that matter services any function of the card or is otherwise assigned to intervene in the functionality of the unmodified or modified card. These may be, for example, at least one of: government agencies, regulatory agencies, banks, credit unions, private entities, and their combination.

Also included in the system implementing the methods provided herein is a backend management server comprising: a management communication interface, adapted for two-way communication with the communication network; a first non-volatile storage device; and a backend processing module (BPM) in communication with each card modifying terminal, the client terminal, and the unmodified card-issuing entity, the BPM further comprising at least one backend processor in communication with a non-volatile storage device having thereon a processor-readable medium with a set of executable instructions configured, when executed, to cause the at least one processor to: receive the unmodified card selection from the user terminal; locate a predetermined card modifying terminal; transmit the selection to the predetermined card modifying terminal; receive the analysis transmittal from the predetermined card modifying terminal; and based on the analysis, inform the card issuing entity. In the context of the systems disclosed, the term backend management server is intended to refer broadly to a computing device such as a server (see e.g., 801, FIG. 8) that includes at least some degree of management capability over devices and assets on the communication network. For example, a network manager deploys a management server to configure, manage, and monitor a portion of the communication network, such as, for example, to determine the card modifying terminal where the queue (assuming multiple requests/terminal) for the physical modification of the selected card is the shortest, meaning execution of the request will return results the fastest; and transmit the request to that terminal.

Moreover, the systems provided herein can be configured to use internal database(s), for example, the first non-volatile storage device in communication with the BCM (micro SQL), to store and/or authenticate users, modified card (and/or winning lottery tickets) images, payments and the like. This Database should be easily synched with main Networking Authentication databases/servers. This feature will allow to provide local Authentication and even Authorization in order to provide advanced level of security and increase the level of reliable secured access to the network. Supported authentication sources for the user can be, for example: lightweight directory access protocol (LDAP), Microsoft Active Directory, Novell eDirectory, OpenLADP or any LDAP compliant server, Cisco ACS, RADIUS (FreeRADIUS, Radiator, etc.), Microsoft NPS, or any RADIUS-compliant server, Local user file (Apache htpasswd format), OAuth2, Facebook, Google, GitHub, LinkedIn, Microsoft Live, Twitter, security assertion markup language (SAML), or a combination comprising the foregoing authentication measures.

In an embodiment, the devices and systems disclosed are used to implement the methods disclosed herein. Accordingly, provided herein is a method of remotely physically scratching a scratch-lottery card (SLC) by a user, implementable in a computerized networked system comprising: a plurality of computerized SLC modifying terminals, each terminal comprising: a physical modification module (PMM); an unmodified SLC holder; an unmodified SLC conveyor; a modified SLC holder; a modified SLC conveyor; an imaging module; a cleaning module; and a central processing module (CPM) in communication with the PMM, the unmodified SLC holder, the unmodified SLC conveyor, potentially the cleaning module, the modified SLC holder the modified SLC conveyor, and the imaging module, the CPM further comprising: a transceiver 506 in communication with a communication network; and at least one processor in communication with a non-volatile storage device having thereon a processor-readable medium with a set of executable instructions configured, when executed, to cause the at least one processor to: receive a request for remotely scratching at least one unmodified SLC; using the unmodified SLC conveyor, convey the unmodified SLC from the unmodified SLC holder to the PMM; scratching the SLC; analyze the scratched SLC; transmit the analysis; and provide the analysis to the user a client terminal comprising: a display; a communication interface, adapted for two-way communication with the communication network; a user interface, adapted to provide the user's input; and a processor, in communication with the display, the communication interface, and the user interface, the processor being in communication with a non-volatile storage device having thereon a processor-readable medium with an application program interface (API) configured, when executed, to cause the processor to: receive input from the user configured to select the SLC to be remotely scratched; transmit the selected SLC to a backend management server; receive an analysis of the selected, remotely scratched SLC; and render the analysis results on the display; the unmodified SLC issuing entity; and a backend management server comprising: a management communication interface, adapted for two-way communication with the communication network; a first non-volatile storage device; and a backend processing module (BPM) in communication with each SLC modifying terminal, the client terminal, and the unmodified SLC-issuing entity, the BPM further comprising at least one backend processor in communication with a second non-volatile storage device having thereon a processor-readable medium with a set of executable instructions configured, when executed, to cause the at least one processor to: receive the unmodified SLC selection from the user terminal; locate a predetermined SLC modifying terminal; transmit the selection to the predetermined SLC modifying terminal; receive the analysis transmittal from the predetermined SLC modifying terminal; and based on the analysis, optionally inform the SLC issuing entity, the method comprising: selecting at least one SLC by the user through the client access terminal; transmitting a request to the backend management server by the user access terminal to scratch the selected SLC; the backend management server, allocating a predetermined SLC modifying terminal; transmitting the request to the predetermined SLC modifying terminal; and remotely scratching the SLC by the predetermined SLC modifying terminal.

In another embodiment, the method further comprises using the imaging module, analyzing the remotely scratched SLC; based on communication received from the SLC issuing entity, determining if the remotely scratched SLC is a winning SLC; if the SLC is a winning SLC, providing the scratched SLC to a manual monitor; if the manual monitor validates the SLC as a winning SLC, informing at least one of the backend management server, the user terminal, and the SLC-issuing entity; otherwise reexamining the SLC using a second monitor. It is noted, that in certain jurisdiction it is prohibited to pre-scratch the SLC and upon selection by the user on the client access terminal, merely delivering the user the results of the pre-scratched SLC. Rather, the sequence of steps must be time-stamped in such a way such that the request must precede physical scratching of the SLC.

Additionally, the method further comprise determining if the SLC is a winning SLC, the backend management server, receiving a financial instrument corresponding to the enumerated winning of the SLC from the SLC-issuing entity: and crediting the user with the winnings. The financial instrument can be a check, a bank note, a wire transfer, or any method affecting payment to the user. Moreover, each SLC scratching terminal, is configured to store the scratched SLC in the scratched SLC holder, while the backend management server stores a captured image of the scratched SLC (or, if a winner, the financial instrument crediting the user with the winnings) on the first non-volatile storage device (e.g., the database).

In an embodiment, the PMM is configured to remove ink from the SLC in at least one predetermined location on the unmodified SLC and the set of executable instructions of the card modifying terminal is further configured, when executed, to cause the at least one processor to: capture an image of the analyzed modified lottery card; determine if the modified lottery card is a winning lottery card; if the modified lottery card is the winning lottery card, provide the card for manual monitoring; otherwise transmit the captured image to the originating user access terminal. The manual monitoring can be used to independently validate and inspect the card, thus providing an added layer of security to the physical record of the process. In the context of the disclosure, the term "manual monitoring" and its derivative, refers to the inspection and validation of the modified card by a third party. The third party monitoring can be either automatic (no human involvement, e.g., through computerized image analysis) or using a representative of any group in the network, for example, at least one of a representative of: the user, the network manager, and the card-issuing entity.

An example of the methods described herein, utilizing the devices, systems and programs disclosed, is illustrated in FIGS. 7A-7C and 8. Turning to FIG. 7A, whereby user 850 downloads 701 the APP containing the API for executing the client portion of the methods disclosed, after which the user registers 702, with the service, verify their identity 703, and sets up the payment method 704 for engaging the service on the network. All three steps forming a part of the users' authentication and authorization by the network.

In the context of this disclosure, authorization, refers to the process of defining the action(s)/network(s)/service(s) that authenticated users and/or remote devices are entitled to, based on user, device, temporospatial location data, and access profiles. In cases of remote access attempts by the user, access profiling can also depend on access provider, temporospatial location, or their combination. It will be appreciated that different combinations of the above processes may be implemented by a common processing module and/or different intercommunicating modules, using different numbers of steps, or iterations, and having different levels of redundancy and/or parallel processing to provide a selected level of efficiency and/or accuracy.

Once authenticated and registered by the system, and the user profile stored in the first database on the backend management server, the user can choose to play the lottery by using a scratch lottery card (SLC) 710 or entering a lottery drawing by purchasing a lottery ticket 750.

Turning now to FIG. 7B, illustrating a flow chart describing an example of the steps implemented by the system for remotely, physically modifying a card while leaving a record of the modified card for inspection and validation and delivering the manipulation results to a user, and/or other third parties. As illustrated, user 850, using client access terminal 851*j* selects the scratch card they wish to play. It is noted the client access terminal (CAT) 851*j*, containing display module can be configured to present a number of SLCs, each stored as unmodified SLC on one or more SLC-modifying terminal in communication with the network. Following selection 710, the user, whose profile is stored by the backend management server (BMS), pays 711 for the service and the payment record is stored 712 on the first database of the BMS. The selected card is then played 713 by identifying 714 user 850 and scratching 715 the SLC by the SLC-modifying terminal (SMT). The card is then inspected and analyzed 716, for example using the imaging/MFP module in the SMT and the scratched SLC is rendered 717 to the CAT display module. If the SLC is determined 718 to be a winning card (e.g., by employing image recognition mechanism that compares the numbers revealed on the card face against data provided by the SLC-issuing authority 810), the card is removed for additional inspection and validation 719, where if winning validation 720 is confirmed and the SLC is indeed a winning card, the result is posted 721, and the user account provided initially (see e.g., 701-703, FIG. 7A) is credited 722. If however, the manual inspection 719 determines a discrepancy in the original determination 718, the physical card is removed for revalidation 724 by a third party (in other words, not the SMT or the user) where additional validation 725 takes place. If the card is determined in the revalidation to be a winning card, the results will be posted 721 to the user's CAT. If however, a determination is inconclusive, or the card is determined NOT to be a winning card, the physical card will be sent to resolution center for additional inspection 726, and a final validation query 727 will take place, and the results will post 721 to the user. In addition, once results are posted 721 by the system to the user's device, the user can apply for arbitration to resolution center 726 for final arbitration. It is noted that the resolution center is preferably the administrator of the system, but not necessarily where the BMS is physically located.

Turning now to FIG. 7C, illustrating a flow chart describing an example of the steps implemented by the system for playing the lottery by selecting a lottery ticket for a drawing while simultaneously maintaining a physical record of the selected ticket for independent inspection and validation; followed by delivering the drawing results to a user, and/or other third parties. As illustrated, user 850, using CAT $\mathbf{851}_j$, select the lottery ticket desired 750. It is noted, that similarly to the SLCs, here too, there may be many different drawings offered at any given time and user 850 can get a rendering on the display module of the CAT of these (lottery) tickets and choose at least one of these tickets, while the BMS will have the data to direct the selection to the proper terminal for execution. In the context of the disclosure, "lottery ticket" or "ticket" and their derivative(s) shall refer to any type of ticket, including an electronic representation of a ticket, used in any type of lottery game offered by a lottery game provider. It is noted that, there are two basic types of lottery games that are popular—drawing-type lottery games and instant-type lottery games. These lottery games include any number of variations and combinations. The present systems, methods and programs can be applied to these and other types of lottery games.

Accordingly, following payment 751 by the user, the operation is stored 752 on the BMS database, the necessary forms are filled 753, either automatically by scanning terminal (e.g., SMT) 801*i*, or by the associated MFP module $\mathbf{803}_p$, and delivered to scanning terminal 754, after which, the physical lottery ticket is printed 755 (locally) and issued 756 to the user (rendered on the user CAT $\mathbf{851}_j$ 758, while simultaneously, an image of the issued lottery ticket is scanned and stored 757 by MFP module 803*p* to the database. A winning query 759 is done by, for example, comparing the image of the stored ticket data obtained in 757 against an image or code scheme obtained from the national lottery provider. If the ticket is determined to be a winner, results are posted 760 to the user's CAT 851*j* and the user account is credited 761.

An example for such game administration algorithm is set forth in the attached appendix in .txt format.

As indicated, the set of executable instructions of the BPM is further configured, when executed, to cause the at least one processor to: determine the card game selected by the user; allocate the game to the card modifying terminal where the queue for the physical modification of the selected unmodified card is the shortest; and transmit the selected card request to that terminal. An example for such allocation algorithm is set forth in the attached appendix in .txt format.

Also, using the systems, methods and computer-readable medium provided herein, it may be possible to support integration with online billing/payment solution(s) such as Authorize.net, PayPal, Stripe and more. Using this integration, user/client can handle online payments, required, for example, to get proper network access, pay for SLC and collect winnings.

It is therefore possible to implement a profile, which defines the registration workflow that will be used, for example, whether the user is a subscriber or not, whether the numbers played are used consistently or chosen every access, etc. In other words, the user/client can define different portal profiles based attribute stored on the BMS.

In the context of the disclosure, the term "node" refers to a gateway device, a network switch, a network functions virtualization ("NFV") entity, a software defined network ("SDN") controller or a combination thereof.

As used herein, the term "processor" is defined as including, but not necessarily being limited to, an instruction execution system such as a computer/processor based system, an Application Specific Integrated Circuit (ASIC), a computing device, or a hardware and/or software system that can fetch or obtain the logic from a non-transitory storage medium or a non-transitory computer-readable storage medium and execute the instructions contained therein. "Processor" can also include any controller, state-machine, microprocessor, cloud-based utility, service or feature, or any other analogue, digital and/or mechanical implementation thereof. In addition, the computer program (software and/or firmware), can comprise program code means for carrying out the steps of the methods described herein, as well as a computer program product comprising program code means stored on a medium that can be read by a computer, such as a hard disk, SATA CD-ROM, DVD, USB memory stick, or a storage medium that can be accessed via a data network, such as the Internet or Intranet, when the computer program product is loaded in the main memory of a computer and is carried out by the computer. Thus, the terms "non-transitory storage medium" and non-transitory computer-readable storage medium" are defined as including, but not necessarily being limited to, any media that can contain, store, or maintain programs, information, and data. Non-transitory storage medium and non-transitory computer-readable storage medium may include any one of many physical media such as, for example, electronic, magnetic, optical, electromagnetic, or semiconductor media.

More specific examples of suitable non-transitory storage medium and non-transitory computer-readable storage medium include, but are not limited to, a magnetic computer diskette such as floppy diskettes or hard drives, magnetic tape, a random access memory (RAM), a read-only memory (ROM), an erasable programmable read-only memory (EPROM), a flash drive, a compact disc (CD), or a digital video disk (DVD).

Non-transitory storage (Memory) device(s) as used in the methods described herein can be any of various types of non-transient memory devices or storage devices (in other words, memory devices that do not lose the information thereon in the absence of power). The term "memory device" is intended to encompass an installation medium, e.g., a CD-ROM, floppy disks, or tape device or a non-transient memory such as a magnetic media, e.g., a hard drive, optical storage, or ROM, EPROM, FLASH, etc. The memory device may comprise other types of memory as well, or combinations thereof. In addition, the memory medium may be located in a first computer in which the programs are executed, and/or may be located in a second different computer which connects to the first computer over a network, such as the Internet. In the latter instance, the second computer may further provide program instructions to the first computer for execution. The term "memory device" can also include two or more memory devices which may reside in different locations, e.g., in different computers that are connected over a network.

Further, the processor may be operably coupled to the various modules and components with appropriate circuitry. may also be used herein, the term(s) "operably coupled to", "coupled to", and/or "coupling" includes direct coupling between items and/or indirect coupling between items via an intervening item (e.g., an item includes, but is not limited to, a component, an element, a circuit, an engine, and/or a module) where, for indirect coupling, the intervening item does not modify the information of a signal but may adjust its current level, voltage level, and/or power level. As may further be used herein, inferred coupling (i.e., where one element is coupled to another element by inference) includes direct and indirect coupling between two items in the same manner as "coupled to". As may even further be used herein, the term "operable to" or "operably coupled to" indicates that an item includes one or more of power connections, input(s), output(s), etc., to perform, when activated, one or more its corresponding functions and may further include inferred coupling to one or more other items. As may still further be used herein, the term "associated with", includes direct and/or indirect coupling of separate items and/or one item being embedded within another item.

The term "module" is used herein to refer to software computer program code and/or any hardware or circuitry utilized to provide the functionality attributed to the module. Further, the term "module" or "component" can also refer to software objects or routines that execute on the computing system. The different components, modules, engines, and services described herein may be implemented as objects or processes that execute on the computing system (e.g., as separate threads). Likewise, "BMS" (see e.g., FIG. 8, 810), refers to a network device which receives data at multiple input ports and provides that data to an output port (e.g., capable of returning a value in an ARP table), for transmission over a communication link, and may also include computer networking devices such as a hub, router, bridge, gateway, multilayer switch and the like. In an embodiment, BMS 810 is a network switch configured to support layer 3 switching/Routing.

Unless specifically stated otherwise, as apparent from the following discussions, it is appreciated that throughout the specification discussions utilizing terms such as "processing," "loading," "in communication," "detecting," "calculating," "determining", "analyzing," or the like, refer to the action and/or processes of a computer or computing system, or similar electronic computing device, that manipulate and/or transform data represented as physical, such as a transistor architecture into other data similarly represented as physical and structural layers.

As may also be used herein, the terms "central processing module" (CPM), "module", "processing circuit", and/or "processing unit" may be a single processing device or a plurality of processing devices. Such a processing device may be a microprocessor, micro-controller, digital signal processor, microcomputer, central processing unit, field programmable gate array, programmable logic device, state machine, logic circuitry, analog circuitry, digital circuitry, and/or any device that manipulates signals (analog and/or digital) based on hard coding of the circuitry and/or operational instructions (in other words, firmware). The processor, processing circuit, and/or processing unit may have an associated memory and/or an integrated memory element, which may be a single memory device, a plurality of memory devices, and/or embedded circuitry of the processing module, module, processing circuit, and/or processing unit. Such a memory device may be a read-only memory, random access memory, transient memory, non-transient memory, static memory, dynamic memory, flash memory, cache memory, and/or any device that stores digital information.

Note that if the processor, module, servers, network switches etc., processing circuit, and/or processing unit in ludes more than one processing device, the processing devices may be centrally located or may be distributed (e.g., cloud computing via indirect coupling via a local area network and/or a wide area network). Still further it is noted that, the memory element may store, and processor, module, processing circuit, and/or processing unit executes, hard coded and/or operational instructions corresponding to at least some of the steps and/or functions illustrated in one or more of FIG. 8 elements. Such a memory device or memory element can b and is included in an example as an article of manufacture.

The term "comp sing" and its derivatives, as used herein, are intended to be open ended terms that specify e presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives.

All ranges disclosed herein are inclusive of the endpoints, and the endpoints are independently combinable with each other. "Combination" is inclusive of blends, mixtures, alloys, reaction products, and the like. The terms "a", "an" and "the" herein do not denote a limitation of quantity, and are to be construed to cover both the singular and the plural, unless otherwise indicated herein or clearly contradicted by context. The suffix "(s)" as used herein is intended to include both the singular and the plural of the term that it modifies, thereby including one or more of that term (e.g., the location(s) includes one or more location). Reference throughout the specification to "one embodiment", "another embodiment", "an embodiment", and so forth, when present, means that a particular element (e.g., step, feature, structure, and/or characteristic) described in connection with the embodiment is included in at least one embodiment described herein, and may or may not be present in other embodiments. In addition, it is to be understood that the described elements may be combined in any suitable manner in the various embodiments.

Accordingly an in an exemplary implementation, provided herein is a networked device for physically modifying a plurality paper cards, comprising: a physical modification module (PMM); an unmodified card holder; an unmodified card conveyor a physically modified card holder; a modified card conveyor; an imaging module; optionally a cleaning module; and a central processing module (CPM) in communication with the PMM, the unmodified card holder, the unmodified card conveyor, potentially the cleaning module, the physically modified card holder the modified card conveyor, and the imaging module, the CPM further comprising: a transceiver in communication with a communication network; and at least one processor in communication with a non-volatile storage device having thereon a processor-readable medium with a set of executable instructions configured, when executed, to cause the at least one processor to: receive a request for modifying at least one unmodified card; using the unmodified card conveyor, convey the unmodified card from the unmodified card holder to the PMM; physically modify the card; analyze the modified card; transmit the analysis; and deliver the modified card to the modified cards holder, wherein (i) the set of executable instructions are further configured, when executed, to cause the at least one processor to: prior to analyzing the modified card, using the modified cards conveyor, conveying the modified card to the cleaning module; and cleaning the modified card, (ii) the unmodified card is at least one of: a lottery scratch card, and a ballot card, wherein (iii) the PMM comprises: a conveying platform a modifying member having a distal end sized and configured to remove a portion of the unmodified card, coupled to the conveying platform, and wherein the conveying platform is configured to move at least one of the modifying member, the distal end of the modifying member, and the unmodified card in an X-Y direction, wherein (iv) the imaging module comprises a charge coupled devices (CCDs), a complimentary metal-oxide semiconductor (CMOS), or a combination comprising one or more of the foregoing, (v) the PMM is configured to remove ink in at least one predetermined location on the card, (vi) the PMM is configured to form an opening in the card at a predetermined location, wherein (vii) the plurality of unmodified cards form a single roll wherein each card is separated from an adjacent card by at least one of: scoring perforation, machine-readable marker, and a blank gap, and wherein (viii) the single roll is adapted to form a Z-fold section.

In another exemplary implementation, provided herein is a networked computerized card-modifying system, comprising: a plurality of computerized card modifying terminals, each terminal comprising: a physical modification module (PMM); an unmodified card holder; an unmodified card conveyor; a physically modified card holder; a modified card conveyor; an imaging module; optionally a cleaning module; and a central processing module (CPM) in communication with the PMM, the unmodified card holder, the unmodified card conveyor, potentially the cleaning module, the physically modified card holder the modified card conveyor, and the imaging module, the CPM further comprising: a transceiver in communication with a communication network; and at least one processor in communication with a non-volatile storage device having thereon a processor-readable medium with a set of executable instructions configured, when executed, to cause the at least one processor to: receive a request for modifying at least one unmodified card; using the unmodified card conveyor, convey the unmodified card from the unmodified card holder to the PMM; physically modify the card; analyze the modified card; transmit the analysis; and convey the modified card to the modified cards holder a client terminal comprising: a display; a communication interface, adapted for two-way communication with the communication network; a user interface, adapted to provide the user input; and a processor, in communication with the display, the communication interface, and the user interface, the processor being in communication with a non-volatile storage device having thereon a processor-readable medium with an application program interface configured, when executed, to cause the processor to: receive input from the user configured to select a card to be remotely physically modified; transmit the selected card to a backend management server; receive an analysis of the physical modification of the selected card; and render the analysis results on the display; the unmodified card issuing entity; and a backend management server comprising: a management communication interface, adapted for two-way communication with the communication network; a first non-volatile storage device; and a backend processing module (BPM) in communication with each card modifying terminal, the client terminal, and the unmodified card-issuing entity, the BPM further comprising at least one backend processor in communication with a non-volatile storage device having thereon a processor-readable medium with a set of executable instructions configured, when executed, to cause the at least one processor to: receive the unmodified card selection from the user terminal; locate a predetermined card modifying terminal; transmit the selection to the predetermined card modifying terminal; receive the analysis transmittal from the predetermined card modifying terminal; and based on the analysis, inform the card issuing entity, wherein (ix) each card modifying terminal is further configured to provide the analyzed modified card to a manual monitor, (x) the unmodified card is at least one of: a lottery scratch card, and a ballot card, (xi) the unmodified card-issuing entity is at least one of: a lottery administrating agency, and an election administering agency, the system further comprising (xii) a plurality of user terminals, wherein (xiii) the set of executable instructions of the BPM is further configured, when executed, to cause the at least one processor to: determine the card modifying terminal where the queue for the physical modification of the selected unmodified card is the shortest; and transmit the selected card request to that terminal, wherein (xiv) the unmodified card is the scratch lottery card, the PMM is configured to remove ink in at least one predetermined location on the unmodified lottery card and the set of executable instructions of the card modifying terminal is further configured, when executed, to cause the at least one processor to: capture an image of the analyzed modified lottery card; determine if the modified lottery card is a winning lottery card; if the modified lottery card is the winning lottery card, provide the card for manual monitoring; otherwise transmit the captured image to the originating user access terminal, wherein (xv) wherein the plurality of unmodified cards form a single roll wherein each card is separated from an adjacent card by at least one of: scoring perforation, machine-readable marker, and a blank gap, and wherein (xvi) the single roll is adapted to form a Z-fold section.

In yet another exemplary implementation, provided herein is a method of remotely physically scratching a scratch-lottery card (SLC) by a user, implementable in a computerized networked system comprising: a plurality of computerized SLC modifying terminals, each terminal comprising: a physical modification module (PMM); an unmodified SLC holder; an unmodified SLC conveyor; a modified SLC holder; a modified SLC conveyor; an imaging module; a cleaning module; and a central processing module (CPM) in communication with the PMM, the unmodified SLC holder, the unmodified SLC conveyor, potentially the cleaning module, the modified SLC holder the modified SLC conveyor, and the imaging module, the CPM further comprising: a transceiver in communication with a communication network; and at least one processor in communication with a non-volatile storage device having thereon a processor-readable medium with a set of executable instructions configured, when executed, to cause the at least one processor to: receive a request for remotely scratching at least one unmodified SLC; using the unmodified SLC conveyor, convey the unmodified SLC from the unmodified SLC holder to the PMM; scratching the SLC; analyze the scratched SLC; transmit the analysis; and provide the analysis to the user a client terminal comprising: a display; a communication interface, adapted for two-way communication with the communication network; a user interface, adapted to provide the user's input; and a processor, in communication with the display, the communication interface, and the user interface, the processor being in communication with a non-volatile storage device having thereon a processor-readable medium with an application program interface (API) configured, when executed, to cause the processor to: receive input from the user configured to select the SLC to be remotely scratched; transmit the selected SLC to a backend management server; receive an analysis of the selected, remotely scratched SLC; and render the analysis results on the display; the unmodified SLC issuing entity; and a backend management server comprising: a management communication interface, adapted for two-way communication with the communication network; a first non-volatile storage device; and a backend processing module (BPM) in communication with each SLC modifying terminal, the client terminal, and the unmodified SLC-issuing entity, the BPM further comprising at least one backend processor in communication with a second non-volatile storage device having thereon a processor-readable medium with a set of executable instructions configured, when executed, to cause the at least one processor to: receive the unmodified SLC selection from the user terminal; locate a predetermined SLC modifying terminal; transmit the selection to the predetermined SLC modifying terminal; receive the analysis transmittal from the predetermined SLC modifying terminal; and based on the analysis, optionally inform the SLC issuing entity, the method comprising: selecting at least one SLC by the user; transmitting a request to the backend management server by the user access terminal to scratch the selected SLC; the backend management server, allocating a predetermined SLC modifying terminal; transmitting the request to the predetermined SLC modifying terminal; and remotely scratching the SLC by the predetermined SLC modifying terminal, wherein the method further comprises (xvii) using the imaging module, analyzing the remotely scratched SLC; determining if the remotely scratched SLC is a winning SLC; if the SLC is a winning SLC, providing the scratched SLC to a manual monitor; if the manual monitor validates the SLC as a winning SLC, informing at least one of the backend management server, the user terminal, and the SLC-issuing entity; otherwise reexamining the SLC using a second monitor, wherein the system further comprises (xvii) a plurality of additional users, each user having an additional user terminal, each comprising: a display; a communication interface, adapted for two-way communication with the communication network; a user interface, adapted to provide the user's input;

and a processor, in communication with the display, the communication interface, and the user interface, the processor being in communication with a non-volatile storage device having thereon a processor-readable medium with the application program interface (API), wherein (xviii) the step of allocating the predetermined SLC modifying terminal to each user access terminal comprises: determining where the queue for the scratching of the selected unmodified SLC is the shortest; and transmitting the selected request to that terminal, the method further comprising (xix) if the SLC is a winning SLC, the backend management server, receiving a financial instrument corresponding to the enumerated winning of the SLC from the SLC-issuing entity: and crediting the user with the winnings, (xx) each SLC scratching terminal, further storing the scratched SLC in the scratched SLC holder; the backend management server, storing a captured image of the scratched SLC on the first non-volatile storage device; and if the SLC is a winning SLC, the backend management server storing an image of the financial instrument on the first non-volatile storage device, wherein (xxi) the plurality of unmodified paper cards in the networked system, form a single roll wherein each card is separated from an adjacent card by at least one of: scoring perforation, machine-readable marker, and a blank gap, wherein (xxii) the step of remotely scratching the SLC by the predetermined SLC modifying terminal, is preceded by a step of: using a rotatable transfer drum included in the system, pulling the single roll to a corresponding location in the PMM; using the rotatable transfer drum, pulling the single roll to a corresponding location in at least one of: an imaging module, and a scanning module; and capturing an image of the scanned card, and wherein the method further comprises (xxiii) using the rotatable transfer drum pulling the single cards' role to the modified card holder, forming a Z-folded stack of modified cards.

Although the foregoing disclosure has been described in terms of some embodiments, other embodiments will be apparent to those of ordinary skill in the art from the disclosure herein. Moreover, the described embodiments have been presented by way of example only, and are not intended to limit the scope of the inventions. Indeed, the novel methods, programs, devices and systems described herein may be embodied in a variety of other forms without departing from the spirit thereof. Accordingly, other combinations, omissions, substitutions and modifications will be apparent to the skilled artisan in view of the disclosure herein.

What is claimed:

1. A networked device for physically modifying a plurality paper cards, comprising:

a. a physical modification module (PMM);

b. an unmodified lottery scratch card holder;

c. an unmodified lottery scratch card conveyor;

d. a physically modified lottery scratch card holder;

e. a modified lottery scratch card conveyor;

f. an imaging module; and g. a central processing module (CPM) in communication with the PMM, the unmodified lottery scratch card holder, the unmodified lottery scratch card conveyor, the physically modified lottery scratch card holder, the modified lottery scratch card conveyor, and the imaging module, the CPM further comprising: a transceiver in communication with a communication network; and at least one processor in communication with a non-transitory storage device having thereon a processor-readable medium with a set of executable instructions configured, when executed, to cause the at least one processor to:

i. receive a request for modifying at least one unmodified lottery scratch card;

ii. using the unmodified lottery scratch card conveyor, convey the at least one unmodified lottery scratch card from the unmodified lottery scratch card holder to the PMM;

iii. physically modify the at least one lottery scratch card;

iv. analyze the at least one modified lottery scratch card;

v. transmit the analysis; and vi. deliver the at least one modified lottery scratch card to the physically modified lottery scratch cards holder.

2. The networked device of claim 1, wherein the PMM comprises:

a. a conveying platform; and b. a modifying member having a distal end sized and configured to remove a portion of the at least one unmodified lottery scratch card, coupled to the conveying platform, and wherein the conveying platform is configured to move at least one of the modifying member, the distal end of the modifying member, and the at least one unmodified lottery scratch card in an X-Y direction.

3. The networked device of claim 2, wherein the imaging module comprises a charge coupled device (CCDs), a complimentary metal-oxide semiconductor (CMOS), or a combination comprising one or more of the foregoing.

4. The networked device of claim 2, wherein the PMM is configured to remove a covering layer in at least one predetermined location on the at least one unmodified lottery scratch card.

5. The networked device of claim 2, wherein the PMM is configured to form an opening in the at least one unmodified lottery scratch card at a predetermined location.

6. The networked device of claim 1, wherein the plurality of unmodified lottery scratch cards form a single roll wherein each lottery scratch card is separated from an adjacent unmodified lottery scratch card by at least one of: a scoring perforation, a machine-readable marker, and a blank gap.

7. The networked device of claim 6, wherein the single roll is adapted to form a Z-fold section.

8. A networked computerized lottery scratch card-modifying system, comprising:

a. a plurality of networked, computerized lottery scratch card modifying terminals, each networked lottery scratch card modifying terminal comprising: a physical modification module (PMM); an unmodified lottery scratch card holder; an unmodified lottery scratch card conveyor; a physically modified lottery scratch card holder; a modified lottery scratch card conveyor; an imaging module; and a central processing module (CPM) in communication with the PMM, the unmodified lottery scratch card holder, the unmodified lottery scratch card conveyor, the physically modified lottery scratch card holder, the modified lottery scratch card conveyor, and the imaging module, the CPM further comprising: a transceiver in communication with a communication network; and at least one processor in communication with a non-transitory storage device having thereon a processor-readable medium with a set of executable instructions configured, when executed, to cause the at least one processor to:

i. receive a request for modifying at least one unmodified lottery scratch card;

ii. using the unmodified lottery scratch card conveyor, convey the at least one unmodified lottery scratch card from the unmodified lottery scratch card holder to the PMM;

iii. physically modify the at least one unmodified lottery scratch card;

iv. analyze the at least one modified lottery scratch card;

v. transmit the analysis; and vi. convey the at least one modified lottery scratch card to the physically modified lottery scratch card holder b. a networked client terminal comprising: a display; a communication interface, adapted for two-way communication with the communication network; a user interface, adapted to provide the user input; and a processor, in communication with the display, the communication interface, and the user interface, the processor being in communication with a non-transitory storage device having thereon a processor-readable medium with an application program interface configured, when executed, to cause the processor to:

i. receive an input from the user configured to select the unmodified lottery scratch card selected by the user to be remotely physically modified;

ii. transmit the unmodified lottery scratch card selection to the backend management server;

iii. receive the analysis of the physical modification of the selected unmodified lottery scratch card; and iv. render the analysis results on the display;

c. an unmodified lottery scratch card issuing entity; and d. the backend management server comprising: a management communication interface, adapted for two-way communication with the communication network; a first non-transitory storage device; and a backend processing module (BPM) in communication with each lottery scratch card modifying terminal, the client terminal, and the unmodified lottery scratch card-issuing entity, the BPM further comprising at least one backend processor in communication with a non-transitory storage device having thereon a processor-readable medium with a set of executable instructions configured, when executed, to cause the at least one processor to:

i. receive the unmodified lottery scratch card selection from the networked user terminal;

ii. locate a networked predetermined lottery scratch card modifying terminal;

iii. transmit the selection to the predetermined networked lottery scratch card modifying terminal;

iv. receive the analysis transmittal from the predetermined networked lottery scratch card modifying terminal; and v. based on the analysis, inform the unmodified lottery scratch card issuing entity.

9. The system of claim 8, wherein each networked lottery scratch card modifying terminal is further configured to provide the analyzed modified lottery scratch card to a manual monitor.

10. The system of claim 9, wherein the unmodified lottery scratch card-issuing entity is a lottery administrating agency.

11. The system of claim 9, further comprising a plurality of networked user terminals.

12. The system of claim 11, wherein the set of executable instructions of the BPM is further configured, when executed, to cause the at least one processor to:

a. determine the at least one networked lottery scratch card modifying terminal where a queue for the physical modification of the selected unmodified lottery scratch card is the shortest; and b. transmit the selected lottery scratch card requested to that networked lottery scratch card modifying terminal.

13. The system of claim 12, wherein the PMM is configured to remove a covering layer in at least one predetermined location on the at least one unmodified lottery scratch card and the set of executable instructions of the networked lottery scratch card modifying terminal is further configured, when executed, to cause the at least one processor to:

a. capture an image of the analyzed modified lottery scratch card;

b. determine if the modified lottery scratch card is a winning lottery scratch card;

c. if the modified lottery scratch card is the winning lottery scratch card, provide the lottery scratch card for manual monitoring; otherwise d. transmit the captured image to at least one originating user access terminal from the plurality of user terminals.

14. The system of claim 8, wherein the plurality of unmodified lottery scratch cards form a single roll, wherein each lottery scratch card is separated from an adjacent lottery scratch card by at least one of: a scoring perforation, a machine-readable marker, and a blank gap.

15. The system of claim 14, wherein the single roll is adapted to form a Z-fold section.

16. A method of remotely physically scratching a scratch-lottery card (SLC) by a user, implementable in a computerized networked system comprising:

a plurality of computerized SLC modifying terminals, each SLC modifying terminal comprising: a physical modification module (PMM); an unmodified SLC holder; an unmodified SLC conveyor; a modified SLC holder; a modified SLC conveyor; an imaging module; and a central processing module (CPM) in communication with the PMM, the unmodified SLC holder, the unmodified SLC conveyor, the modified SLC holder, the modified SLC conveyor, and the imaging module, the CPM further comprising: a transceiver in communication with a communication network; and at least one processor in communication with a non-volatile storage device having thereon a processor-readable medium with a set of executable instructions configured, when executed, to cause the at least one processor to:

i. receive a request for remotely scratching at least one unmodified SLC;

ii. using the unmodified SLC conveyor, convey the unmodified SLC from the unmodified SLC holder to the PMM;

iii. scratching the SLC;

iv. analyze the scratched SLC;

v. transmit the analysis; and vi. provide the analysis to the user a client terminal comprising: a display; a communication interface, adapted for two-way communication with the communication network; a user interface, adapted to provide the user's input; and a processor, in communication with the display, the communication interface, and the user interface, the processor being in communication with a non-volatile storage device having thereon a processor-readable medium with an application program interface (API) configured, when executed, to cause the processor to:

i. receive input from the user configured to select the SLC to be remotely scratched;

ii. transmit the selected SLC to a backend management server;

iii. receive an analysis of the selected, remotely scratched SLC; and iv. render the analysis results on the display;

the unmodified SLC issuing entity; and a backend management server comprising: a management communication interface, adapted for two-way communication with the communication network; a first non-volatile storage device; and a backend processing module (BPM) in communication with each SLC modifying terminal, the client terminal, and the unmodified SLC issuing entity, the BPM further comprising at least one backend processor in communication with a second non-transitory storage device having thereon a processor-readable medium with a set of executable instructions configured, when executed, to cause the at least one processor to:

i. receive the unmodified SLC selection from the user terminal;

ii. locate a predetermined SLC modifying terminal;

iii. transmit the selection to the predetermined SLC modifying terminal;

iv. receive the analysis transmittal from the predetermined SLC modifying terminal; and v. based on the analysis, optionally inform the SLC issuing entity-, the method comprising:

a. selecting at least one SLC by the user;

b. transmitting a request to the backend management server by the user access terminal to scratch the selected SLC;

c. the backend management server, allocating a predetermined SLC modifying terminal;

d. transmitting the request to the predetermined SLC modifying terminal; and e. remotely scratching the SLC by the predetermined SLC modifying terminal.

17. The method of claim 16, further comprising:

a. using the imaging module, analyzing the remotely scratched SLC;

b. determining if the remotely scratched SLC is a winning SLC;

c. if the scratched SLC is the winning SLC, providing the scratched winning SLC to a manual monitor;

d. if the manual monitor validates the scratched winning SLC as the winning SLC, informing at least one of: the backend management server, the networked user terminal, and the SLC-issuing entity; otherwise e. reexamining the winning scratched SLC using a second monitor.

18. The method of claim 17, wherein the system comprises a plurality of additional users, each additional user having an additional user terminal, each additional user terminal comprising: a display; a communication interface, adapted for two-way communication with the communication network; a user interface, adapted to provide the user's input; and a processor, in communication with the display, the communication interface, and the user interface, the processor being in communication with a non-transitory storage device having thereon a processor-readable medium with the application program interface (API).

19. The method of claim 18, wherein the step of allocating the predetermined SLC modifying terminal to each networked user access terminal comprises:

a. determining where a queue for the scratching of the selected unmodified SLC is the shortest; and b. transmitting the selected request to that terminal.

20. The method of claim 18, further comprising:

a. for each SLC scratching terminal, further storing the scratched SLC in the modified SLC holder;

b. the backend management server, storing a captured image of the scratched SLC on the first non-transitory storage device; and c. if the SLC is a winning SLC, the backend management server storing an image of the financial instrument on the first non-transitory storage device.

21. The method of claim 16, further comprising a. if the scratched SLC is the winning SLC, the backend management server, receiving a financial instrument corresponding to the enumerated winning of the SLC from the SLC-issuing entity: and b. crediting the user with the winnings.

22. The method of claim 16, wherein the plurality of unmodified SLC in the networked system, form a single roll wherein each SLC is separated from an adjacent SLC by at least one of: scoring perforation, a machine-readable marker, and a blank gap.

23. The method of claim 22, wherein the step of remotely scratching the SLC by the predetermined SLC modifying terminal, is preceded by a step of:

a. using a rotatable transfer drum included in the system, pulling the single roll to a corresponding location in the PMIVI;

b. using the rotatable transfer drum, pulling the single roll to a corresponding location in at least one of: an imaging module, and a scanning module; and c. capturing an image of the scanned card.

24. The method of claim 23, further comprising using the rotatable transfer drum pulling the single SLC roll to the modified SLC holder, forming a Z-folded stack of modified SLCs.

* * * * *